United States Patent [19]

Ristic-Petrovic

[11] 4,187,704

[45] Feb. 12, 1980

[54] HYDRAULIC LOCKING SYSTEM

[76] Inventor: Spasoje Ristic-Petrovic, 860 Royal Oak Ave., Victoria, B.C., Canada, V8X 3T2

[21] Appl. No.: 786,413

[22] Filed: Apr. 11, 1977

[30] Foreign Application Priority Data

Jun. 14, 1976 [CA] Canada ..... 254783

[51] Int. Cl.[2] ..... E05B 51/02

[52] U.S. Cl. ..... 70/263; 70/275; 137/637

[58] Field of Search ..... 70/262, 263, 265, 266, 70/275, DIG. 48, 286; 137/637

[56] References Cited

U.S. PATENT DOCUMENTS

| | | | |
|---|---|---|---|
| 787,575 | 4/1905 | Hofstatter | 70/275 |
| 3,524,334 | 8/1970 | Salvesen | 70/275 |
| 3,633,392 | 1/1972 | Bell et al. | 70/275 |
| 4,033,161 | 7/1977 | Goes | 70/275 |

FOREIGN PATENT DOCUMENTS

| | | | |
|---|---|---|---|
| 1072671 | 6/1967 | United Kingdom | 70/262 |

*Primary Examiner*—Rodney H. Bonck

*Attorney, Agent, or Firm*—Stanley E. Johnson; Richard J. Hicks

[57] ABSTRACT

A vault door lock of a combination type that operates on fluid pressure. The locking system has a master control valve assembly mounted on the rear face of the vault door and operatively associated with variously positionable dials mounted on the front face of the door and reciprocally mounted actuators which pass therethrough. A slave valve mounted on the rear face of the vault door is operated on command from the master control valve. A plurality of locking members are movably mounted on the vault door from one to another of a locking and unlocking position and coupled to the pistons of a piston cylinder assembly for moving the same. The master control valve consists of a plurality of operatively interrelated valves designed to provide an output that actuates the slave valve when such interrelated valves are actuated in a predetermined sequence. An alarm trigger is actuated by the master control valve when the operatively interrelated valves are actuated in a sequence other than the predetermined sequence.

12 Claims, 34 Drawing Figures

DIAL #1
DIAL #2
DIAL #3
A1
A2
A3
H2
G2
F2
E2
D2
C2

A1
A2
A3
B3
C3
D3
E3
F3
G3
H3
I3

V
W
401
402
22A
412
31B
17A
404
30B
396A
395
413
414
415
21
417
400
399
398
411
26A
394
31A
410
416
409
407
393
30A
408
396B
392
391
397
20
406
31
30
26

HYDRAULIC LOCKING SYSTEM

FIELD OF INVENTION

This invention relates generally to combination locks and, more particularly, to a combination lock utilizing fluid pressure. The locking system of the present invention is primarily intended for use in locking vault doors and is described hereinafter with reference to such use. Obviously, however, it may be used for other locking applications where safe, secure locking is required.

BACKGROUND OF INVENTION

Presently known vault door locking systems may be divided into three general categories, namely, electrical, electronic and mechanical. Each has its own advantages and disadvantages in a particular application. Usually, mechanically operated locking systems are limited in their use to small banks, offices and other places where electrical or electronic locking systems are considered too costly.

The present locking system, which operates on fluid pressure, is closely related to the mechanical locking systems but has many advantages thereover. One disadvantage of the mechanical combination lock is that it is not too difficult for an unauthorized person to determine the correct combination to unlock a door on which it is used. This can be done by utilizing a listening device on the lock to detect movement of the mechanical parts and thereby correctly align the combination pins so as to unlock the same. Also, a person skilled in the art can easily, by feel with his finger tips, accomplish the same result. Opening a combination type mechanical lock can also be accomplished by use of a drill. Another disadvantage of the mechanical type lock is that seizure of the mechanical parts can occur. A still further disadvantage of a mechanical lock is that, because of its wide spread use, numerous people have become familiar with their operation and security is becoming more difficult to maintain as time goes on. Because of this, places which employ mechanical combination locking systems are extensively utilizing television cameras, security guards, electric fences, alarm trip means and/or expensive microwave systems as further protection to what should be protected by the lock itself. The electrical back-up systems, however, can be rendered inoperative without affecting the mechanical lock and thus do not provide an integrated complementing protective system.

Electrical or electronic locking systems provide perhaps better security than mechanical combination locks but they are so complex the cost becomes prohibitive and thus their use is very limited.

Accordingly, it is a principal object of the present invention to provide a lock that operates in such a manner it is most difficult, if not impossible, to open without prior knowledge of the combination.

A further object of the invention is to provide a locking system in which the combination can be fairly simple or extremely complicated depending upon the amount of security that might be required. In the case of a complicated combination, a group of persons may share a part of the complete combination.

A still further object of the invention is to provide a locking system in which the combination cannot be discovered by use of listening devices.

SUMMARY OF INVENTION

The foregoing objects are accomplished by a lock provided in accordance with the present invention which utilizes a plurality of valves requiring a particular sequence of operation to direct a pressurized medium to a device that operates the locking member. Electric power is used to drive a pump to pressurize the medium required to operate the lock and thus provides a security system integrating the lock with power requirements of the building. An alarm system can thus be readily utilized in association with the electrical system to provide an early warning when the lock is being tampered with by some unauthorized person.

Accordingly, there is provided in accordance with one aspect of the present invention a control valve assembly comprising:

(a) a plurality of operatively interrelated valves for controlling flow of a pressurized fluid from a source to a common output which operates a lock actuating mechanism, some of said valves being normally open while the others are normally closed; and (b) at least one multi-positionable, manually operable valve actuating mechanism operatively associated with selected ones of said plurality of valves for actuating said plurality of valves in various sequences which includes a predetermined sequence that allows flow of the fluid to said common output.

In accordance with a further aspect of the present invention there is provided a vault door lock comprising a motor driven pump for supplying fluid under pressure and having a inlet line connected to a reservoir and an outlet line connected to a valve system, said valve system comprising a master control valve assembly consisting of a plurality of operatively interrelated valves, a plurality of individually operable distributor valves for actuating said interrelated valves and a slave valve actuated by said master control valve, said slave valve being connected to the pump outlet line, to the cylinders of a piston cylinder assembly operatively connected to locking pins movably mounted on the vault door and said reservoir, and an actuating mechanism for said distributor valves comprising at least one dial rotatably mounted on the vault door and having a shaft reciprocally mounted therein, said shaft being aligned with different ones of the distributor valves when said dial is rotated to different designated positions.

The invention is illustrated by way of example with reference to the accompanying drawings.

GENERAL ARRANGEMENT

Figure 1:
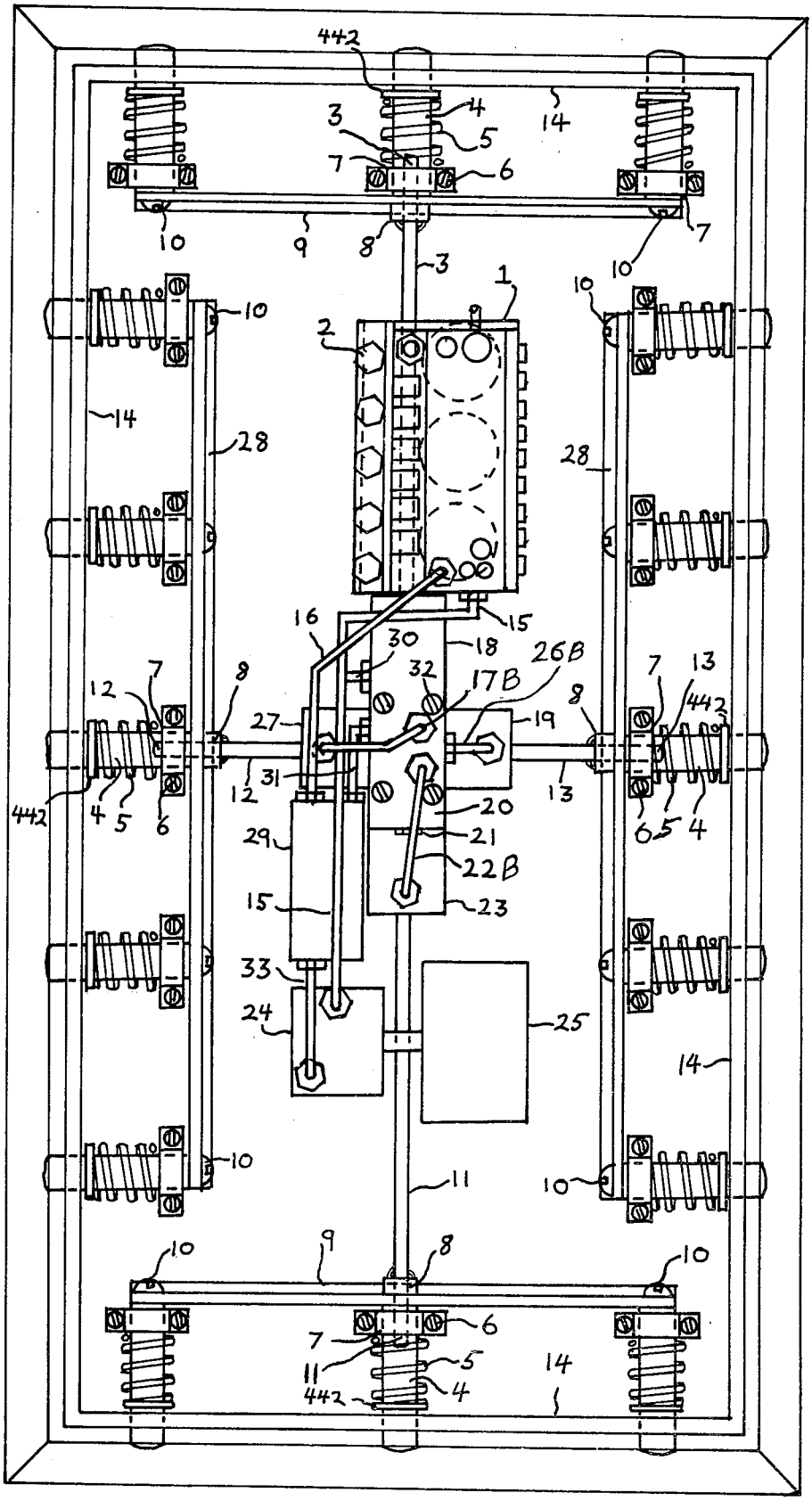
FIG. 1 is a rear elevational view of a vault door and locking system therefor provided in accordance with the present invention.
Figures 2, 3, 4, 5, 6, 7:
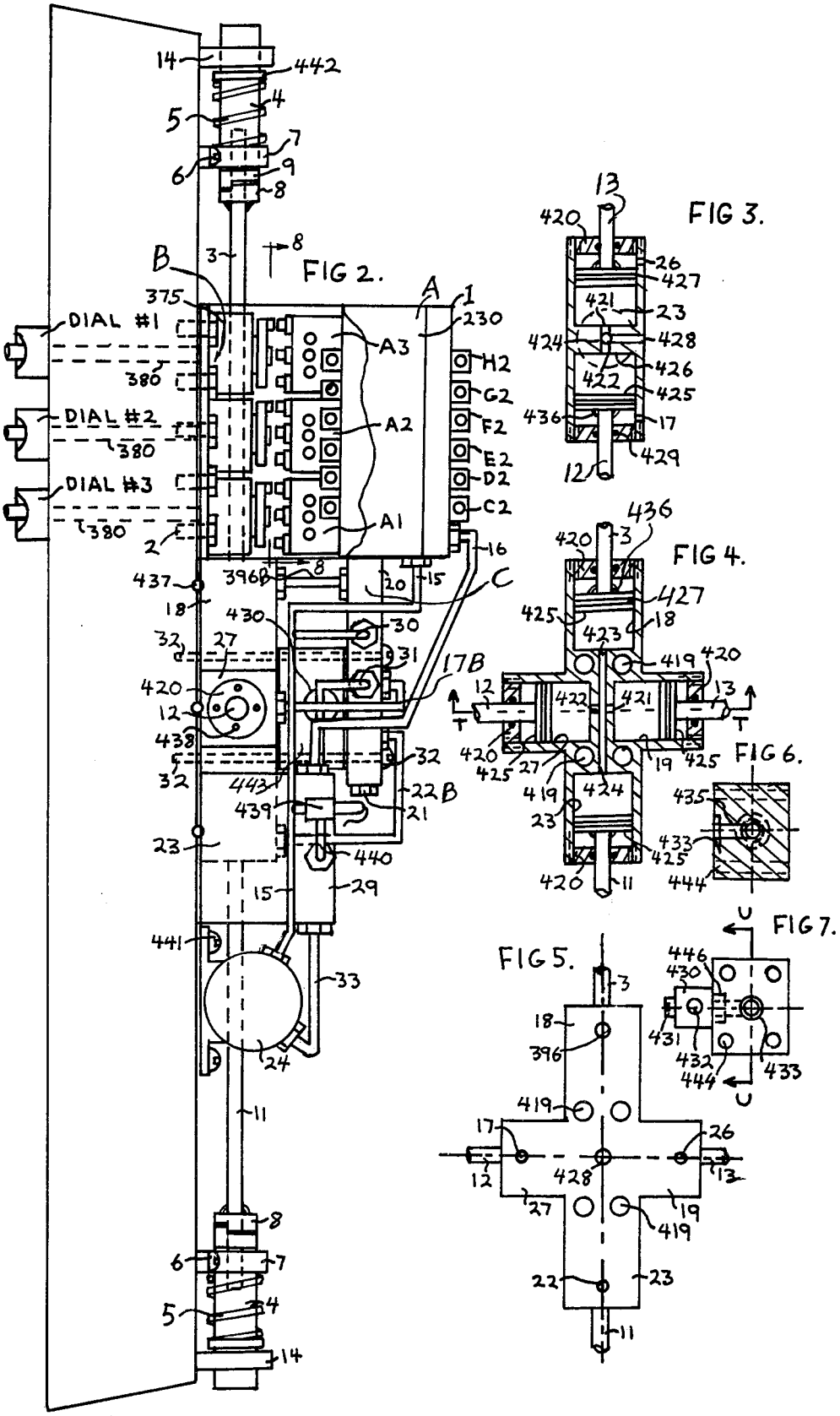
FIG. 2 is a left side view of FIG. 1 with a portion of the valve assembly broken away for clarity of illustration.
FIG. 3 is a sectional view along line T—T of FIG. 4.
FIG. 4 is a cross-sectional view of an assembly of four cylinders with pistons used to operate the locking pins of the vault door.
FIG. 5 is an outside rear view of the assembly illustrated in FIG. 4.
FIG. 6 is a sectional view along line U—U of FIG. 7.
FIG. 7 is a rear elevational view of a spacer for mounting the assembly illustrated in FIG. 4.

The lock of the present invention is a combination type that utilizes a fluid pressure system. The overall arrangement is illustrated in FIGS. 1 and 2 as applied to a vault door and consists of a master control and distributor valve assembly A operatively associated with variously positionable actuators B, a slave valve C operated by the master control and distributor valve A, a plurality of locking members D movable from one to another of a locking and unlocking position, and a piston cylinder assembly E for moving the locking members on command from the master control valve.

The master control and distributor valve assembly consists of a plurality of operatively interrelated valves designed to provide an output that actuates the slave valve when the interrelated valves are actuated in a predetermined sequence. The valve assemblies A and C as well as the locking members D and means E for moving the same are mounted on the rear face of the door inside the vault. The actuators B are also mounted on the rear face of the door and are variously positionable by hand manipulated dials located on the front face of the door. The fluid system is intended to operate at relatively low pressure and thus relatively inexpensive valves may be utilized throughout the entire system.

In the embodiment illustrated, pressurized fluid is provided for the system by a pump 24 mounted on the rear face of the vault door and driven by an electric motor 25. Fluid for the system is contained in a reservoir designated 29. It will, however, be obvious other means may be utilized to provide pressurized fluid for the system. The detailed construction of the system is described hereinafter under various headings relating to the main components of the system.

LOCKING MEMBERS AND MEANS FOR MOVING THE SAME

The locking members consist of a plurality of pins 4 reciprocally mounted on the rear face of the door adjacent the outer periphery thereof and are movable into and out of recesses conventionally located in the structure surrounding the door opening respectively to lock and unlock the door. Each pin 4 is reciprocally mounted in a guide 7 secured to the door by studs 6 and is biased to a locking position by a compression spring 5 bearing at one end against the guide 7 and, at the other end, against a flange 442 secured to the pin. The pins, on the upper and lower edges of the door, as viewed in FIG. 1, are attached to respective ones of a pair of bars 9. Similarly, the pins on the opposite side edges of the door are attached to respective ones of a pair of bars 28. The pair of bars 9, located respectively adjacent the upper and lower edges of the door, are attached to respective rods 3 and 11 by couplings 8 and the pair of bars 28 are similarly attached to respective rods 12 and 13. The rods 3, 11, 12 and 13 are piston rods of a hydraulic piston cylinder assembly illustrated in detail in FIGS. 3, 4 and 5.

The hydraulic piston cylinder assembly for moving the locking pins to an unlocking position consists of four cylinders designated respectively 18, 19, 23 and 27 located in a housing constructed of a single piece. Each cylinder contains a piston 425 reciprocally movable therein and provided with an O-ring seal 427 for the purpose of blocking off the flow of the fluid between the pistons 425 and the wall of the cylinder. Piston rods 3, 11, 12 and 13 pass through gland nuts 420 and are attached to respective ones of the four pistons as by welding 436 or the like. The gland nuts 420 are provided with O-ring seals 429 preventing leakage of fluid from the cylinders along the piston rods. Pressurized fluid provided by pump 24 upon actuation of slave valve C enters the cylinders 19, 27, 18 and 23 through respective holes 26, 17, 396 and 22, and forces the pistons 425 to the bottom 426 of the cylinders. Passages 421, 422, 423 and 424 extend through the bottom 426 of the cylinders and communicate with hole or outlet 428 providing means for relieving back pressure which would otherwise build up.

The housing of the cylinder assembly is provided with four holes 419, through which are inserted bolts 32 mounting the cylinder assembly on the rear face of the vault door. A spacer 443 is placed between the cylinder assembly and a slave valve 20 described in detail hereinafter. The spacer is a single, rectangular block of any suitable material having a passage 435 aligned with the discharge outlet 428 in the cylinder body. A needle valve 430 operatively associated with passage 435 provides means for varying the rate of discharge of fluid from the cylinders through outlet 428. After the back pressure passes through outlet 428 it enters passage 435 which extends half way through spacer 443 (see FIGS. 6 and 7) and then enters the needle valve 430. It passes through the needle valve 430, through a hole 432, and returns to the reservoir 29 (line not shown). Four holes 444 pass through spacer 443 in alignment with holes 419 in the cylinder housing, so that the whole assembly is bolted to the vault door with the four bolts 32. Passage 435 comes out of the spacer to the left and is threaded on the protruding end for the purpose of allowing the needle valve to be adapted.

The purpose of the needle valve is to permit the rate of flow of back pressure to be increased or decreased, thereby increasing or decreasing, respectively, the speed of the pistons 425. The needle valve should be of the type with an adjustment screw 431. It should be noted that the spacer 443 is shown in FIG. 7 bottom side up and that, when the spacer is placed on the top of the centre of the cylinder assembly, the slot 433, in which is inserted a gasket or suitable O-ring, will be on top of the hole 428. The gasket or O-ring will seal the joint. It will be later understood that spacer 443 is necessary to fill the space between slave valve 20 and the cylinder assembly, and also to accommodate needle valve 430.

As shown in FIG. 1, the pump 24 has an inlet line 33 for applying fluid thereto from the reservoir 29, and has an outlet line 15 connected to the master control valve. A fluid presure supply line 30 (a branch of line 15) is connected to the slave valve 20.

SLAVE VALVE

The slave valve 20 (see FIGS. 32, 33 and 34) is a six way valve consisting of a rectangular block of any suitable material having a bore 397 in which a spool 416 is reciprocally mounted and biased to a closed position by a compression spring 400.

The bore 397 passes directly through the valve body and is closed at one end by a plug 21 that serves as an abutment for spring 400. The opposite end of the bore 397 is open allowing a plunger 111, reciprocally mounted in the master control valve assembly 1 and projecting therefrom, to enter the bore and push the spool 416. Opposite end portions of the spool 416, designated respectively 391 and 399, are smaller in diameter than the remainder of the spool so as not to interfere with the bore wall 397. The spool 416 is provided with suitable O-ring seals 392 and 398 adjacent opposite ends which protect the landing part of the spool 416 and bore 397 from any foreign particles.

In order to provide a positive seal the spool 416 should be made to a close tolerance with bore 397. Since this close tolerance should be maintained, the landing part of the spool 416 is lubricated through holes 408, 409, 410 and 411 that communicate with an adjoining chamber 412. During movement of the spool 416 in bore 397, the spool will be constantly lubricated by oil entering from chamber 412 through these holes.

It is important that spool 416 not turn in bore 397 and, for this purpose, a reduced end portion 414 of the spool (on which the spring is located) is provided with a longitudinally extending slot 415. A ball bearing 413, located in plug 21 in such a way as to remain in a fixed position, projects into the slot so that when the spool 416 reciprocates in the bore 397, it is maintained in proper alignment relative to fluid passages in the spool and valve body. Back pressure that will occur through movement of spool 416 is relieved through a passage 417 in the body located near the closed end of the bore 397.

Figures 32, 33, 34:
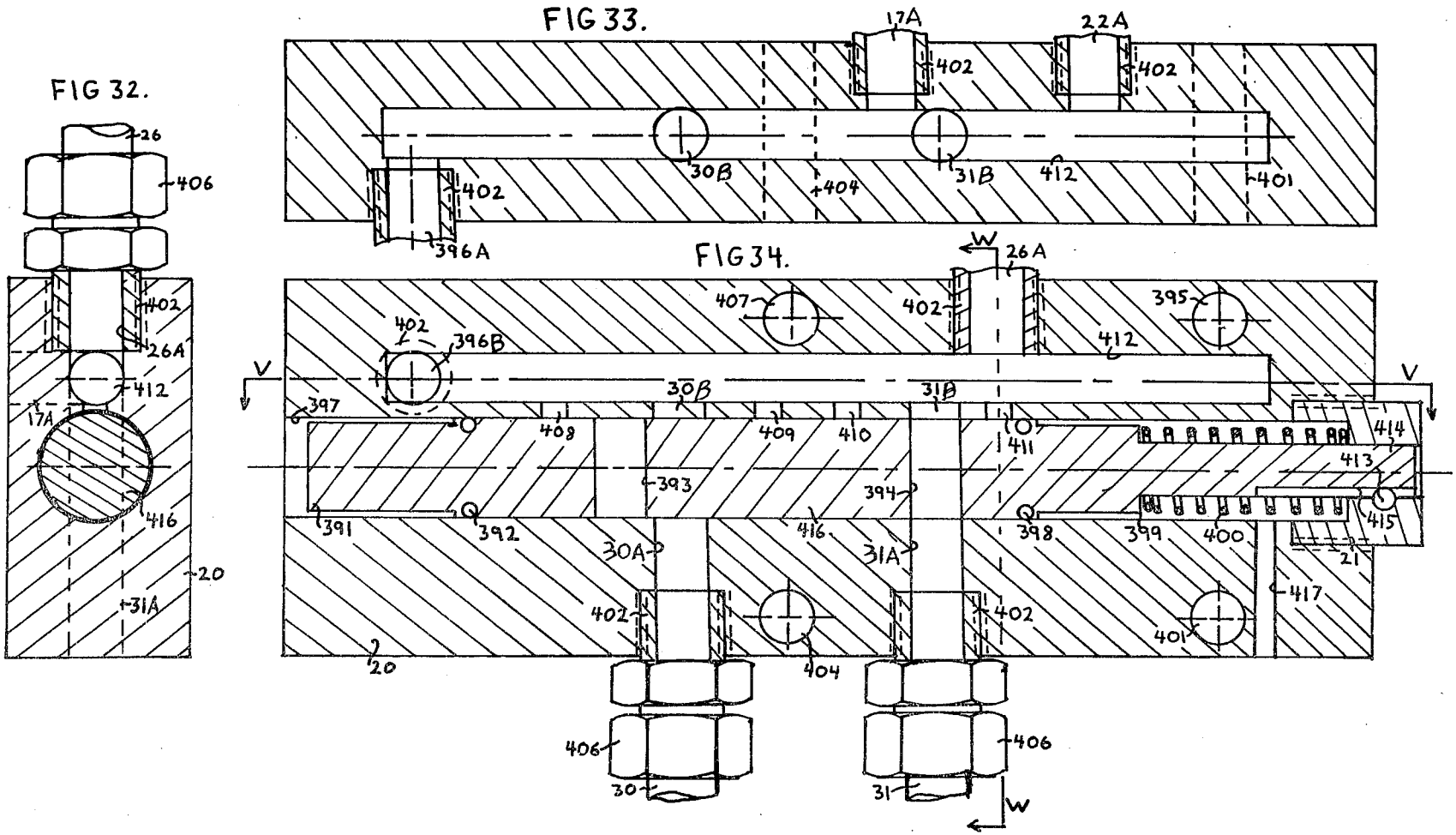
FIG. 32 is a sectional view along line W—W of FIG. 34.
FIG. 33 is a sectional view along line V—V of FIG. 34.
FIG. 34 is a cross-sectional view of a six-way valve for the door lock.

Two holes designated 393 and 394 extend crosswise through the spool 416 and serve respectively to let the fluid from line 30 pass through the spool 416 and return to reservoir 29 via line 31 when the spool is appropriately positioned. In FIG. 34, valve 20 is shown in its closed position and normally maintains that position by the force of spring 400. In this position hole 394 in the spool is aligned with passages 31A and 31B in the valve body. When the spool is moved to the right, as viewed in FIG. 34, by plunger 111 (see FIGS. 8, 13 and 14) against the pressure of spring 400, hole 393 in the spool is brought into alignment with passage 30A, thus allowing fluid from line 30 to enter the hole 393, and then pass into chamber 412 through hole 30B. Chamber 412 has outlets 17A, 22A, 26A and 396A connected via couplings 402 and 406 to fluid conduit lines 17B, 22B, 26B and 396B which, in turn, are connected to respective holes 17, 22, 26 and 396 of the piston cylinder assembly shown in FIGS. 4 and 6. The fluid pressure effects movement of the four pistons of the assembly previously described which retract pins 4 from their locking position to an unlocking position against the force of compression springs 5. When the pressure is released from cylinder 222 of control valve assembly 1 (see FIGS. 13 and 14), the spring 400 will push the spool 416 back towards the left (as viewed in FIG. 34) thereby moving hole 393 and passages 30A, 30B out of alignment, thus closing passage of fluid through line 30. At the same time spool hole 394 will be aligned with passages 31A, 31B, permitting fluid to flow from chamber 412 via return line 31 to the reservoir 29.

The supply and return lines 30 and 31 are connected to the body of slave valve 20 by means of fittings 402 and 406, as are also lines 17B, 22B, 26B and 396B connected in the same manner as return line 31.

As was previously described, pressurized fluid will enter into the cylinders 18, 19, 23 and 27, thereby forcing pistons 425 to move to the end of cylinders 18, 19, 23 and 27. At the same time, piston rods 3, 11, 12 and 13 will pull angle iron bars 9 and 28, on which are connected locking pins 4, out of the vault door frame (not shown). By pulling the pins 4 out of the locking frame, the springs 5 will be compressed between rings 442 and the guides 7. Five pins 4 are attached on each of the angle iron bars 28. Four of these pins, two on either side of the centre pin, are attached to the angle iron bars 28 by means of screws 10 and the centre pins are threaded on to respective piston rods 12 and 13.

On each of the angle iron bars 9, at the top and bottom of the vault door, are three pins 4, the centre ones being threaded onto respective piston rods 3 and 11. The outer pins 4 are attached to the angle iron bars 9 by screws 10.

The couplings 8 are welded onto the respective piston rods 3, 11, 12 and 13 and brace the angle iron bars 9 and 28 which are pressed thereagainst by the centre pins 4.

When the pins 4 are pulled out of the locking frame (not shown), the door is unlocked. It should be noted that, in order for the vault door to be locked, it is necessary to release the fluid pressure from cylinders 18, 19, 23 and 27, and this is done by means of releasing pressure from the cylinder 222 of the master control valve 1 to be described hereinafter. When the pressure is released from cylinder 222, springs 5 push pins 4 into the locking position and, at the same time, pull the pistons 425, forcing fluid from cylinders 18, 19, 23 and 27 through lines 17B, 22B, 26B and 396B into the chamber 412. The depressurized fluid will then pass from chamber 412 through return line 31 into reservoir 29.

The slave valve 20 is placed on top of the spacer 443 and is fastened with the bolts 32 to the door, through the holes 404, 407, 395 and 401. These holes 404, 407, 395 and 401 are drilled through the body of the valve in the same size and manner as holes 419 (which are drilled through the housing of the cylinder assembly), and holes 444 (which are drilled through the spacer 443). When the slave valve 20 is placed on the spacer 443, spool 416 and flange 111 of the master control valve should be in exact alignment so that they can move up and down as one unit.

Exact alignment should be maintained, otherwise the walls of the bore 397 would be damaged by flange 111, and the O-ring seals 223 and 226 would also be damaged. Because of the necessary alignment of flange 111 and spool 416 and since the slave valve 20 is rather thin in size, there is considerable gap between the cylinder assembly and slave valve 20 which is taken up by the spacer 443 and, as previously described, the spacer 443 is also used to adapt the needle valve 430.

MASTER CONTROL AND DISTRIBUTOR VALVE ASSEMBLY

The master control and distributor valve assembly A comprises a main valve assembly designated 1 in FIG. 2 and distributor valve assemblies. In the embodiment illustrated, there are three distributor valves A1, A2 and A3 and the main valve assembly comprises nineteen sliding valves. These valves, when actuated in a predetermined sequence, cause actuation of the slave valve 20 to effect unlocking of the vault door. The 19 slide valves are designated C1, C2, C3 (see FIG. 22, which is a section along line C—C of FIG. 8), D1, D2, D3 (see FIG. 21 which is a section along line D—D of FIG. 8), E1, E2, E3 (see FIG. 20, which is a section along line E—E of FIG. 8), F1, F2, F3 (not shown since F1, F2, F3 are of the same description and arrangement as D1, D2 and D3), G1, G2 and G3 (not shown since G1, G2 and G3 are of the same description and arrangement as E1, E2 and E3), H1, H2 and H3 (see FIG. 9, which is a section along line H—H of FIG. 8) and lastly valve I1 (see FIG. 18, which is a section along line I—I of FIG. 8). These nineteen valves are installed in a valve body as shown in FIGS. 8, 13, 14, 18, 19, 20 and 21.

Figure 15:
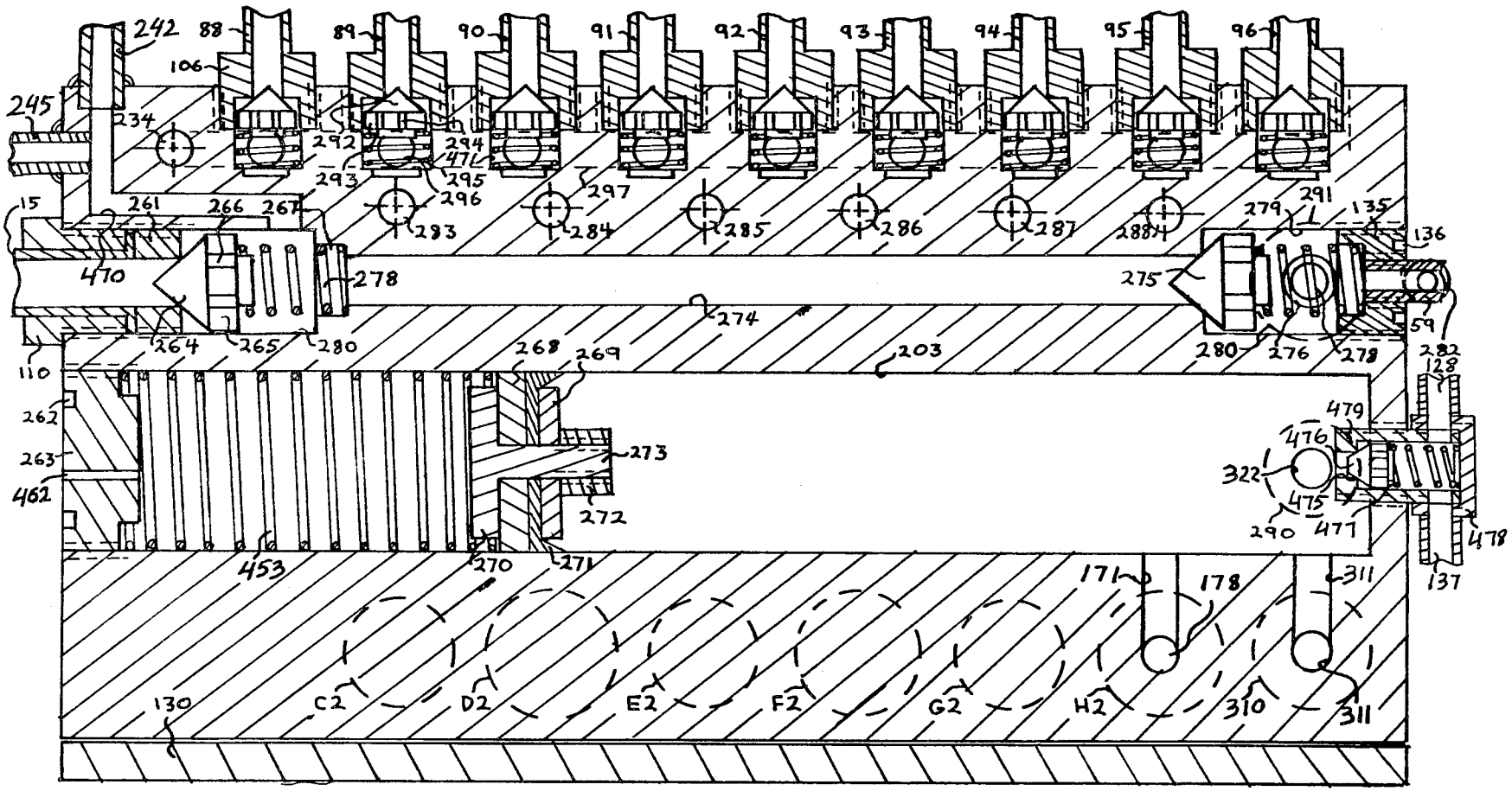
FIG. 15 is a sectional view along line L—L of FIG. 12.
Figure 17:
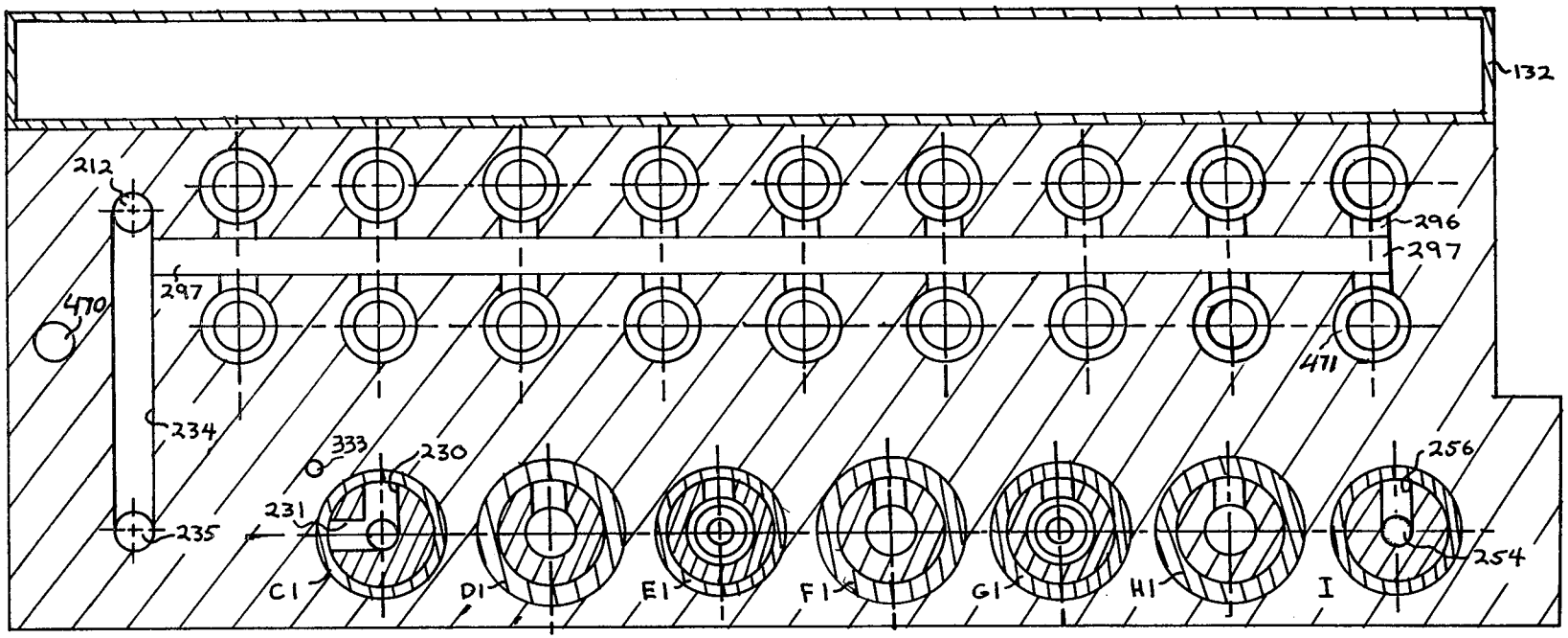
FIG. 17 is a sectional view along line N—N of FIG. 12.
Figure 18:
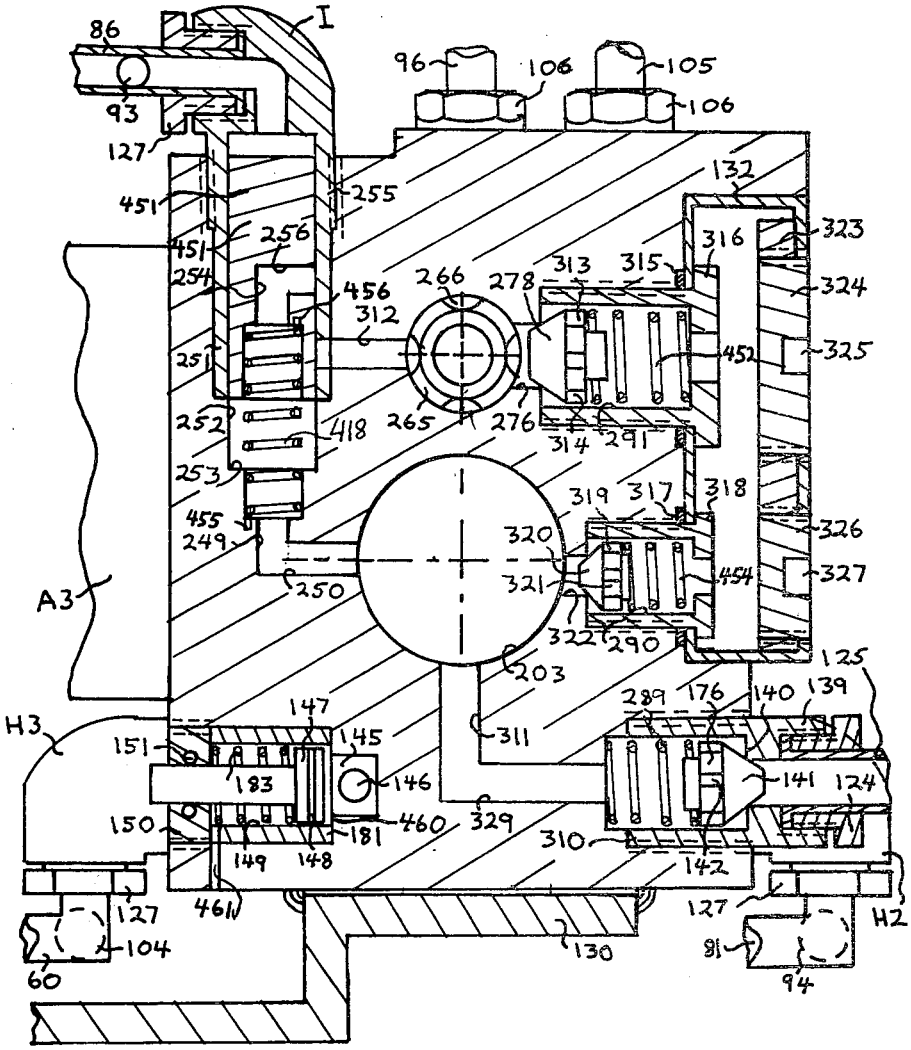
FIG. 18 is a sectional view along line I—I of FIG. 8.

The main valve assembly includes a return terminal 106, installed lengthwise along the upper part of the valve body (see FIGS. 9, 15 and 17) and three check valves 264, 275 and 141 (see FIGS. 15 and 18). Check valves 264 and 275 are installed lengthwise in the valve body, one at each end, and the third check valve 141 is installed in the right-hand side of the valve body of the lock. Two relief valves 278 and 320 are installed in the right-hand end of the valve body.

Figure 13:
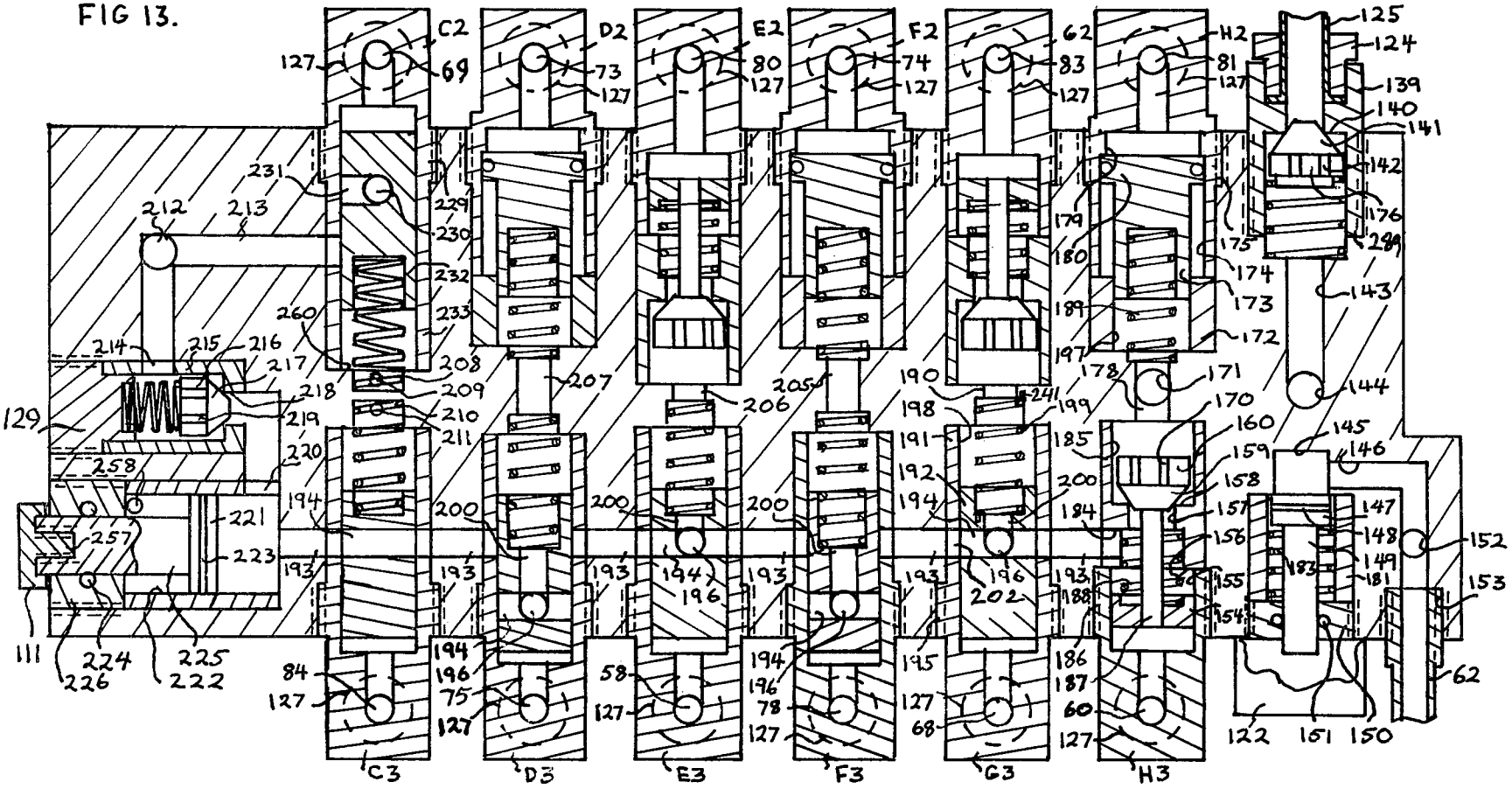
FIG. 13 is a sectional view along line J—J of FIG. 12.
Figure 14:
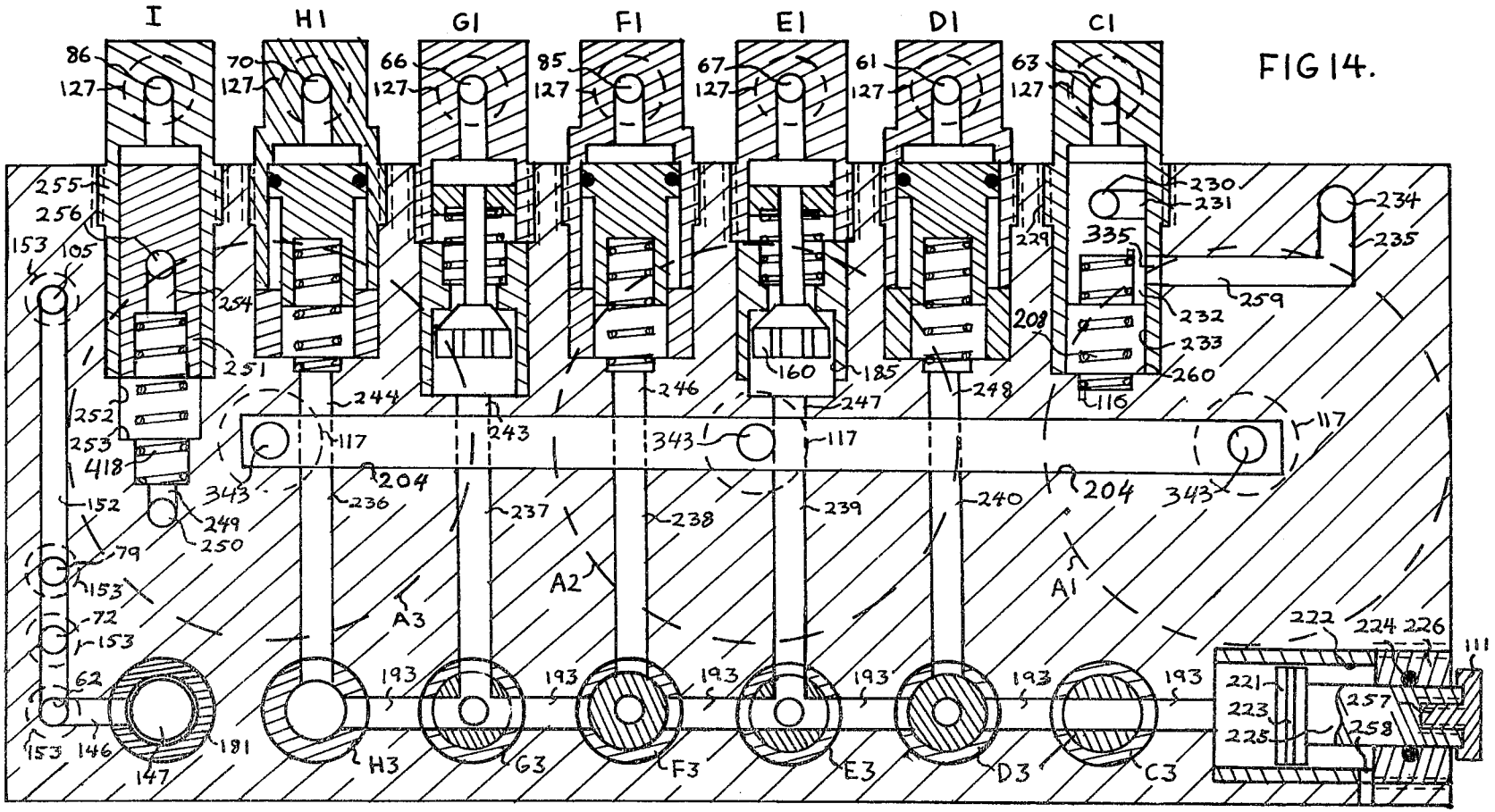
FIG. 14 is a sectional view along line K—K of FIG. 12.

The main valve assembly also includes a reservoir 132, an alarm trigger 181 (see FIGS. 13 and 18) and a lock control cylinder 222 (see FIGS. 13 and 14).

Figure 12:
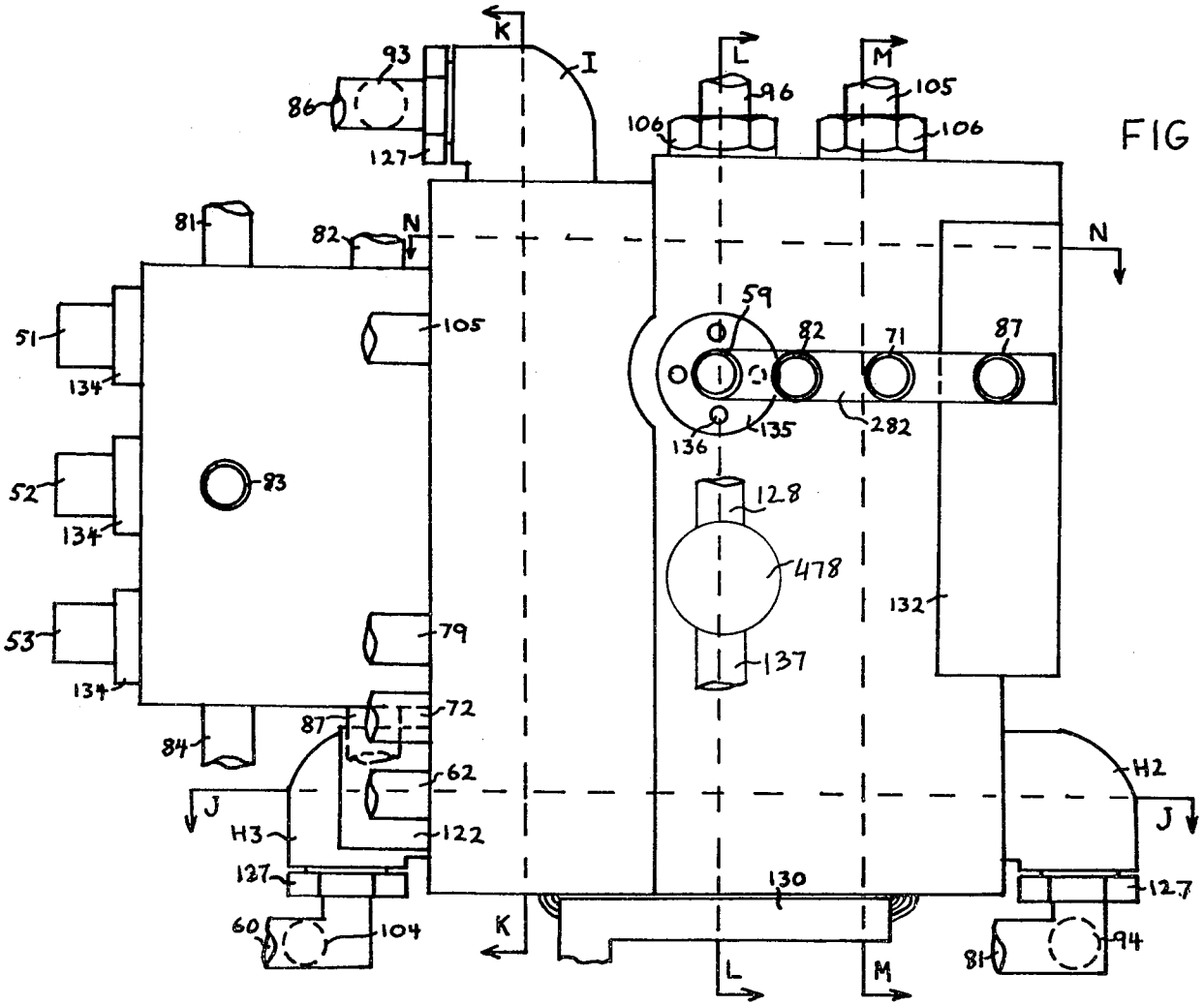
FIG. 12 is a top view of the valve assembly of the lock shown in FIG. 2 and taken as a right hand side elevational view of FIG. 8 as shown on the sheet.

There is a supply terminal 282 (FIGS. 12 and 15) located on the outside of the valve body, three supply lines 204, 274 and 193 extending lengthwise through the valve body of the lock, and one return line 302 also extending lengthwise through the valve body.

Figure 30:
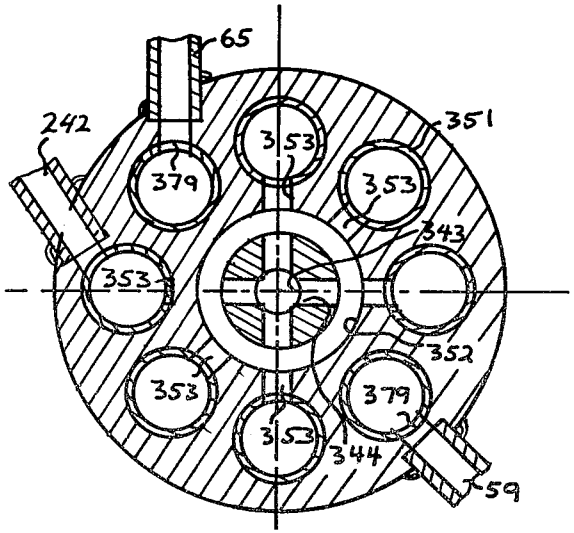
FIG. 30 is a sectional view along line S—S of FIG. 23.

The distributor valves A1, A2 and A3 each consist of eight small valves 34 to 57 inclusive, twenty-four in all which are placed in a circle within the distributor valve body. All three distributor valves are connected to the main valve body with the bolts 117, which are placed through the centre of the body 345 of the distributor valve and threaded, as indicated at 342, into the main valve body. Between the bodies of the distributor valves and the main valve there are O-ring seals 346 for the purpose of stopping any leakage of pressurized fluid from a chamber 352 in the distributor valve body that circumscribes bolt 117. The chamber 352 is supplied with pressurized fluid from passage 204 in the main valve body via passages 343 and 344 located in bolt 117. There are four passages 344, as will be seen from FIG. 30.

Figure 23:
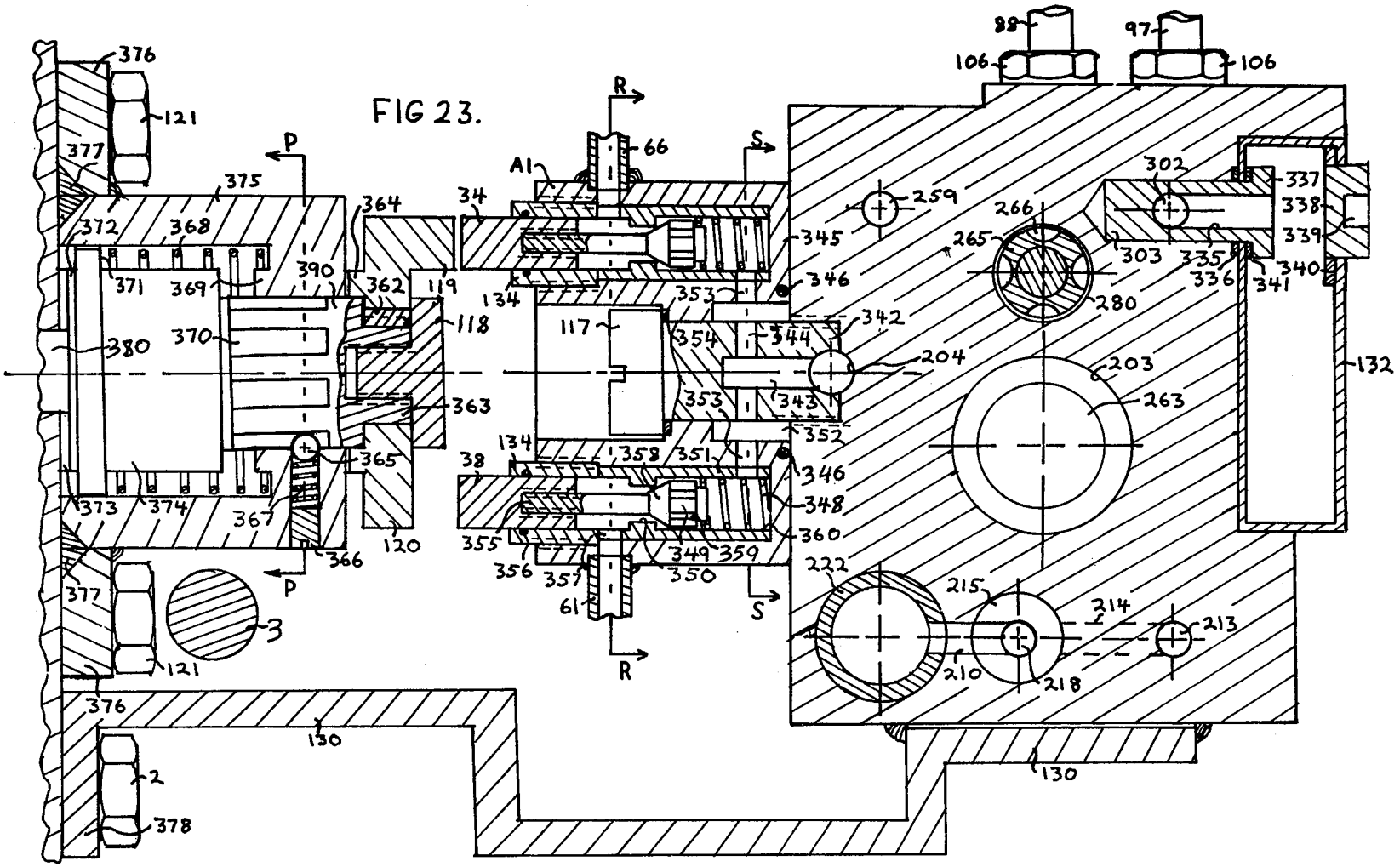
FIG. 23 is a sectional view along line B—B of FIG. 8.
Figure 29:
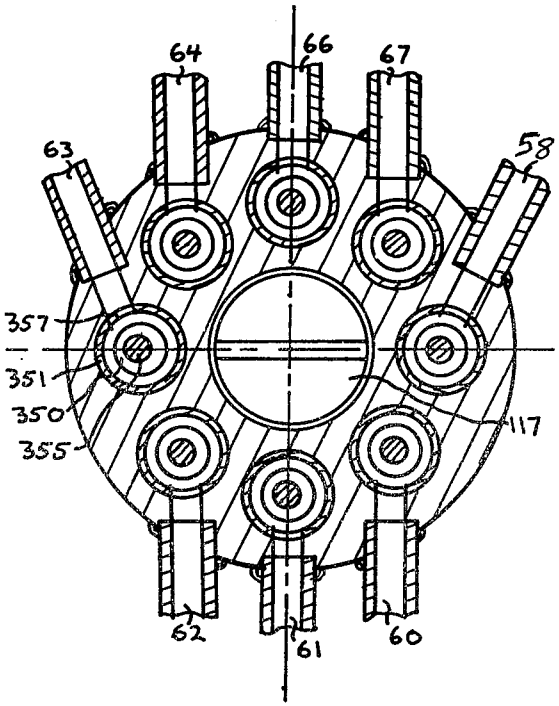
FIG. 29 is a sectional view along line R—R of FIG. 23.
Figure 28:
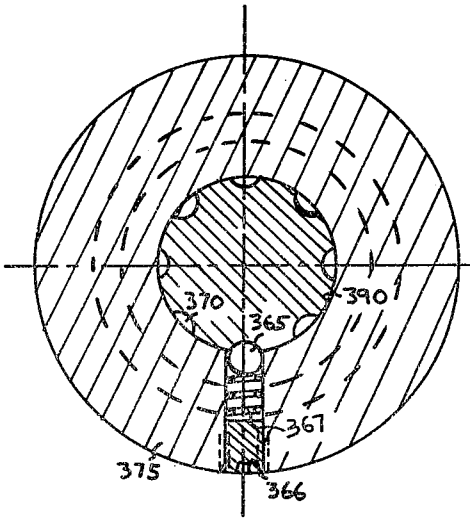
FIG. 28 is a sectional view along line P—P of FIG. 23.

Each valve consists of a pushbar, a piston 358, a piston rod 355 and a spring 348. The piston rod 355 is threaded into the pushbar and, when the pushbar is pressed in by a hand operable mechanism to be described hereinafter, the piston 358 will move away from seat 350 and will slide on its sides 349 down the cylinder 360. Pressurized fluid, which enters the valve cylinders 360 through passage 353, will flow through channels 359, through hole 357 and into the line to which it is connected. In FIG. 23, lines 61 and 66 are shown connected to respective valves 38 and 34. Sixteen of the twenty-four small valves of distributor valves A1, A2 and A3 are connected to the chamber 352 by the passages 353. Four of these small valves are not connected to the chamber 352 but instead directly to the terminal 282 (see FIGS. 29 and 30). The remaining four small valves also are not connected to the chamber 352 but instead they are connected directly to the valves C1 and C2 and passage 470.

Figure 24:
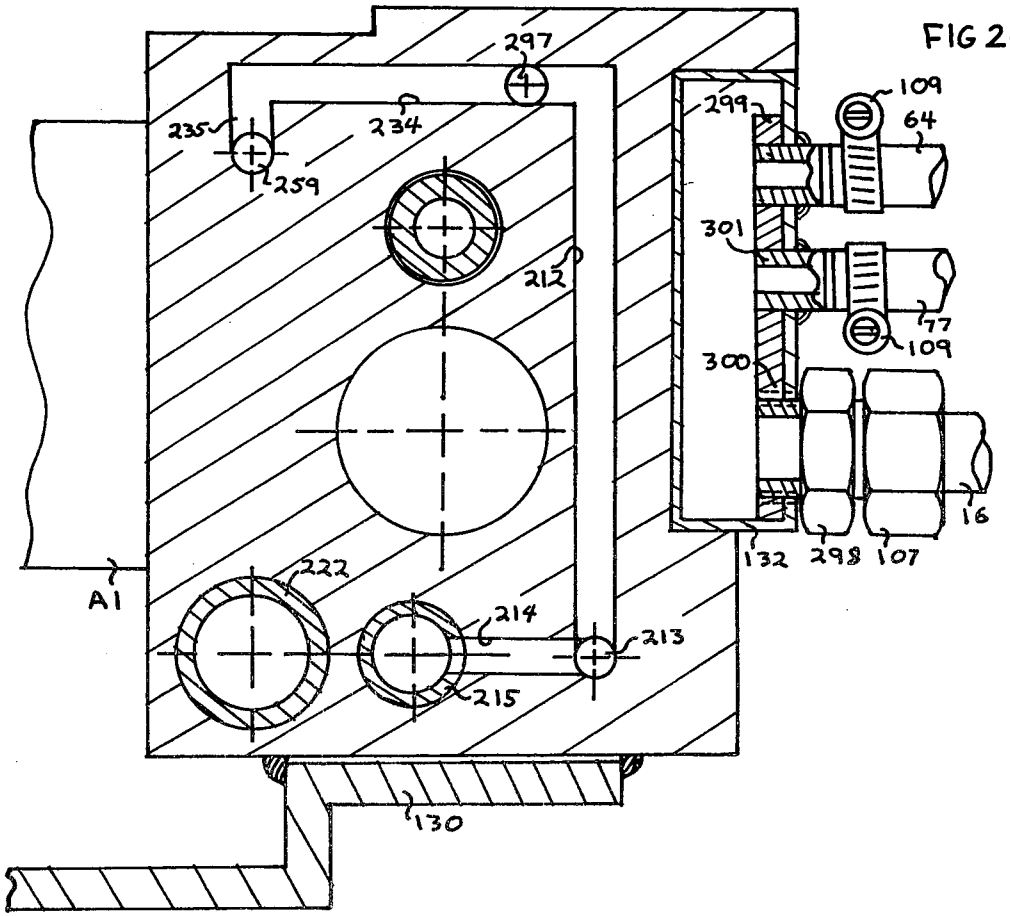
FIG. 24 is a sectional view along line A—A of FIG. 8.

Sixteen of the small valves, namely 34, 35, 36, 38, 39, 44, 45, 46, 47, 49, 50, 52, 53, 54, 55 and 57, which are supplied with pressurized fluid from chamber 352 via the passages 353, have one outlet nipple for each valve welded to the body of the distributor valve, as will be seen in FIGS. 8, 23, 29 and 30. The remaining eight valves 40, 41, 42, 37, 43, 48, 51 and 55, which are not supplied by chamber 352, have two nipples (one for an outlet 70, and one for an inlet 71) welded to be body of the distributor valve (see FIGS. 8, 20, 23, 29 and 30). The nipples are inserted into plastic hoses and if not otherwise preferred, these hoses are tightened on the nipples by means of hose clamps 109, as shown in FIG. 24.

Figure 8:
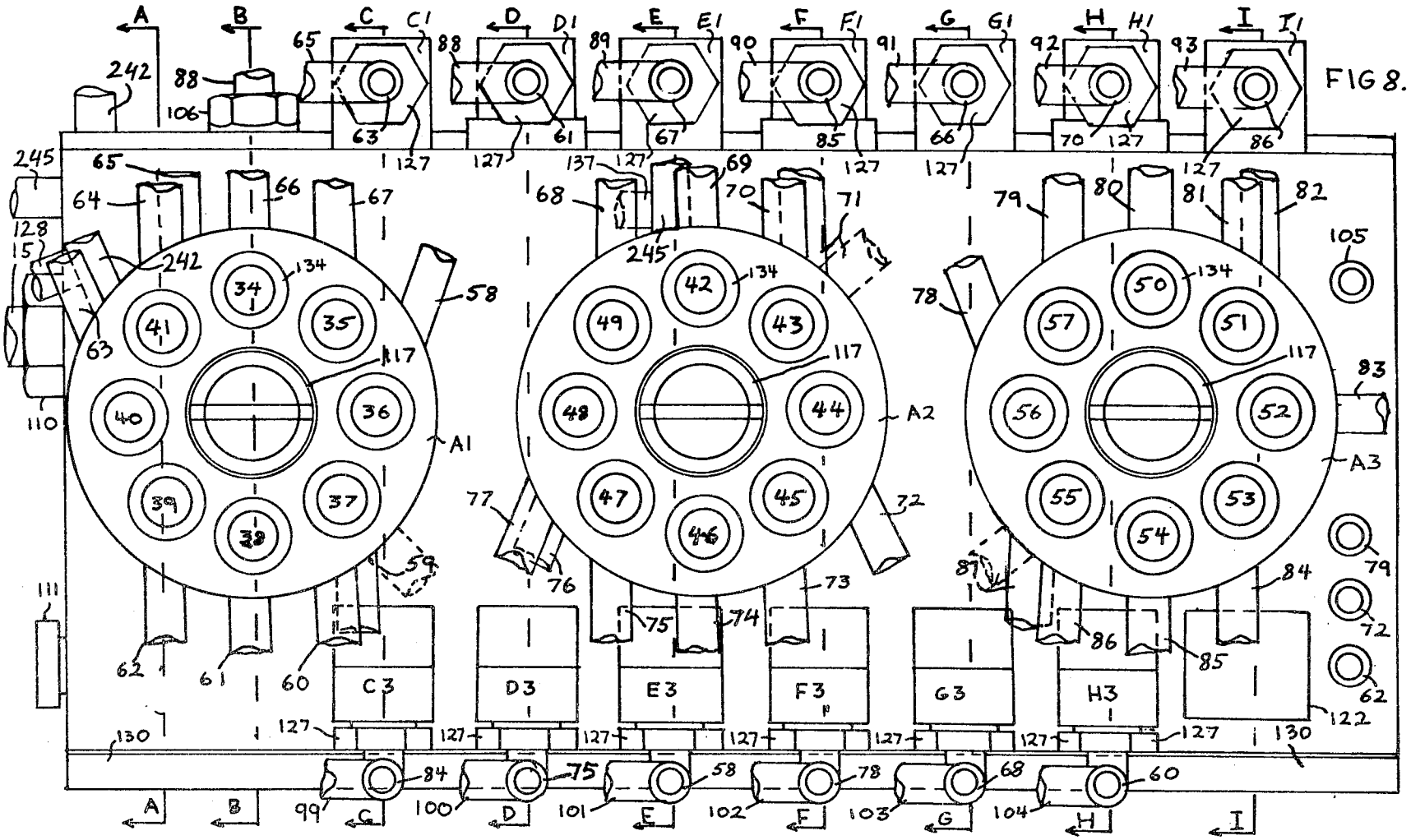
FIG. 8 is a front elevational view taken along line 8—8 of FIG. 2 showing the valve assembly but rotated on the sheet of drawings clockwise through 90°.
Figure 9:
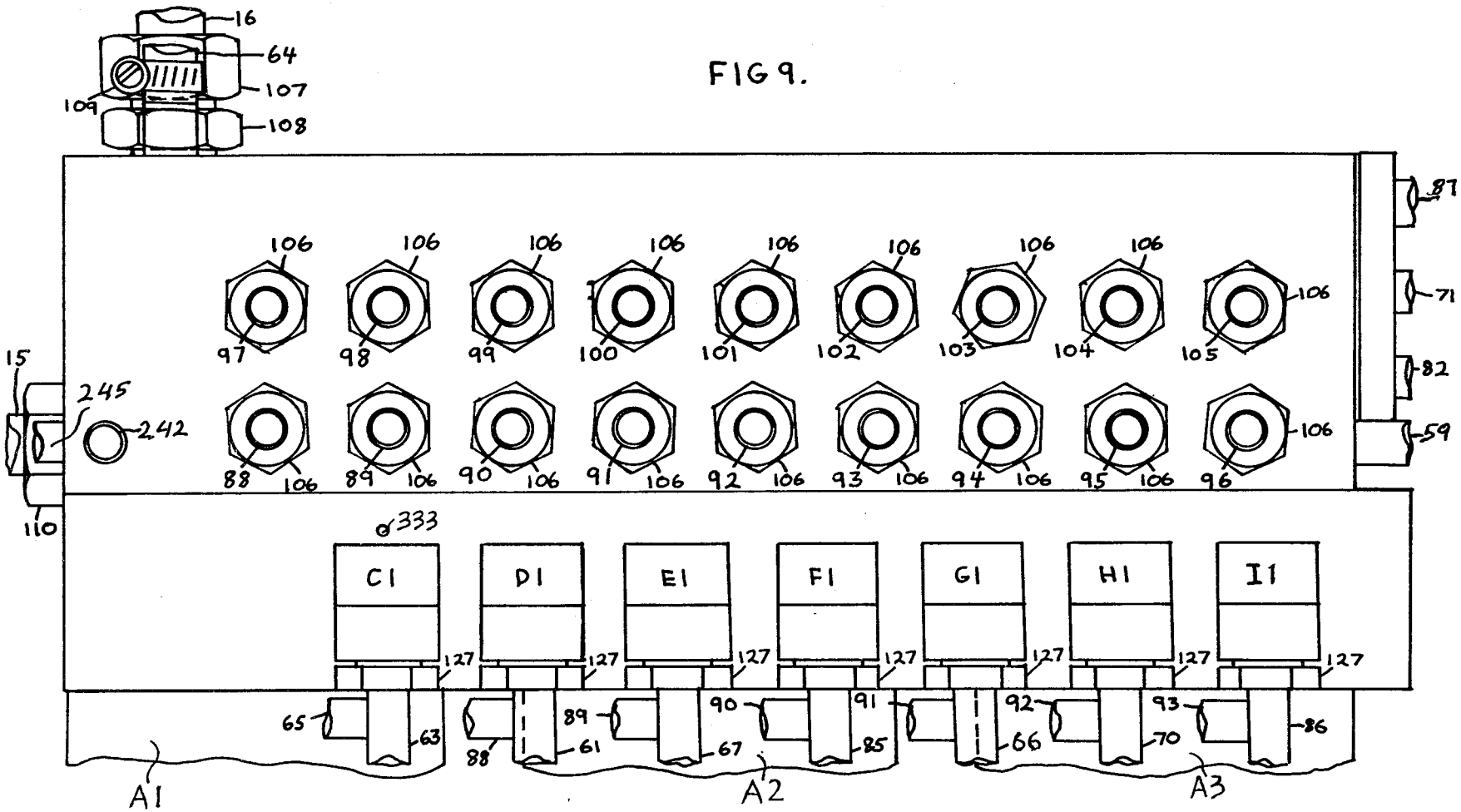
FIG. 9 is a top plan view of FIG. 8 as shown on the sheet of drawings and provides a left hand side elevational view of the valve assembly seen in FIG. 2.

It should be noted that, in FIG. 8, inlet nipple 59 for the valve 37 of distributor valve A1 is shown in line with the outlet nipple 60, however, the proper position of this nipple 59 is as indicated by the dotted line to the right. This is to avoid the blockage of the path of the hose by valve C3. The same holds true for inlet nipple 87 of valve 55 of distributor valve A3 and inlet nipple 71 of valve 43 of distributor valve A2.

As shown in FIGS. 8, 13 and 14, the sliding valves are installed in the main valve body in six sections, taken crosswise of the body and designated C, D, E, F, G and H in FIG. 8. Each section consists of three sliding valves. The seventh section, taken along line I—I of FIG. 8, consists of a single sliding I1 (FIG. 18), two relief valves 316 and 318, and one check valve 141. Also in the seventh section is located alarm trigger 181 which consists of a piston 147, housing 181, cylinder 460, spring 183, O-ring seal 148, and a gland nut 150, through which the narrower part of the piston 147 passes. The gland nut 150 is provided with an O-ring seal 151 to stop any possible leakage during travelling of piston 147 through the gland nut. The enlarged end of the piston 147 is provided with a suitable O-ring seal 148 to provide sealing between the cylinder 149 and the land part of the piston 147. The housing of alarm trigger 181 is inserted into the main valve body, seating against shoulder 460 and is retained in place by the gland nut 150 which is threaded into the main valve body.

The spring 183 is inserted into the cylinder 149 to engage the large part of the piston 147 and on the other end it engages the gland nut 150. To relieve back pressure created through the movement of the piston 147, a hole 461 is drilled through part of the valve body and through the very end of the cylinder housing of the alarm trigger 181.

On top of the gland nut is installed a suitable electric switch 122 (see FIG. 8) which is able to energize an alarm system. The switch is installed in such a way that when the piston 147 is pushed out by pressurized fluid, it actuates the switch to trigger an alarm.

On the other end of the cylinder 149 is located bore 145, which is drilled into the main valve body and connected to the passage 146. The passage 146 is connected to the line 152 (see FIG. 14). The line 152, which is drilled into the main valve body, is connected to the distributor valve A1, with the line 62, by means of a plastic hose. Line 152 is connected to the distributor valve A2, with the line 72, by means of a plastic hose. Also, line 152 is connected to distributor valve A3, with the line 79, by means of a plastic hose, and line 152 is connected to return terminal 106, with the line 105, by means of a plastic hose.

Also in this seventh section (a section along line I—I of FIG. 8) are located two relief valves 316 and 318 and one check valve 141.

The housings of the relief valves 316 and 318 are inserted in through the reservoir 132, and threaded into the main valve body. Relief valve 316 is installed on the end of the supply line 274 and the other relief valve 318 is installed on the end of a master cylinder or passage 203 in the main valve body. The check valve 141 is also installed on the end of the master cylinder 203. The check valve 141 is connected to the master cylinder 203 on its outlet end, via passage 311, and on its inlet end to a line 125, to the optical centrally operated pump which will be described below. The purpose of the check valve 141 is to stop any return of pressurized fluid from the master cylinder 203. When the fluid is introduced into the check valve 141, through the line 125, it pushes the piston away from the seat 140, and it flows through the channels 142, through the passage 311, into the master cylinder 203. When the introduction of fluid is stopped, the force of the spring 289 will return the piston 176 to the seat 140 and pressurized fluid from the master cylinder 203 will hold the piston 176 tight against the seat 140. This way, any return from the master cylinder 203 will be stopped.

The relief valve 316 is connected to the supply line 274 with the passage 276 and its purpose is to relieve surplus pressure from supply line 274. The pressurized fluid enters into the relief valve from supply line 274, through passage 276, and pushes piston 278 away from the seat. The piston 278 slides inside cylinder 291 on its sides 314, and pressurized fluid flows through the four channels 313, which are provided on the sides of the piston, and into the reservoir 132. The strength of spring 452 is decided by the required pressure of the system. For instance, if a pressure of 30 psi is required to operate the system, the spring 452 should be strong enough to hold the piston 278 firmly against the seat until the pump 24 builds up pressure to 30 psi. When this pressure is reached, the pressurized fluid will push piston 278 away from the seat and pass through channels 313 into the reservoir 132. If the pressure is lower than 30 psi, the force of spring 452 will push the piston against the seat and the flow through the passage 276 will be stopped. If so desired, this relief valve may be made adjustable. The relief valve 318, which is connected to the master cylinder 203 by the passage 322, is intended to protect master cylinder 203 in case of excessive fluid pressure being supplied by the means of a central pump. If the pressure in the master cylinder 203 exceeds the strength of the spring 454, the pressurized fluid, which comes from the master cylinder 203 through the passage 322, will push piston 320 away from the seat and the piston 320 will slide through the cylinder 290 on its sides 319 and then pressurized fluid will flow through the channels 321 into the reservoir 132.

Figure 16:
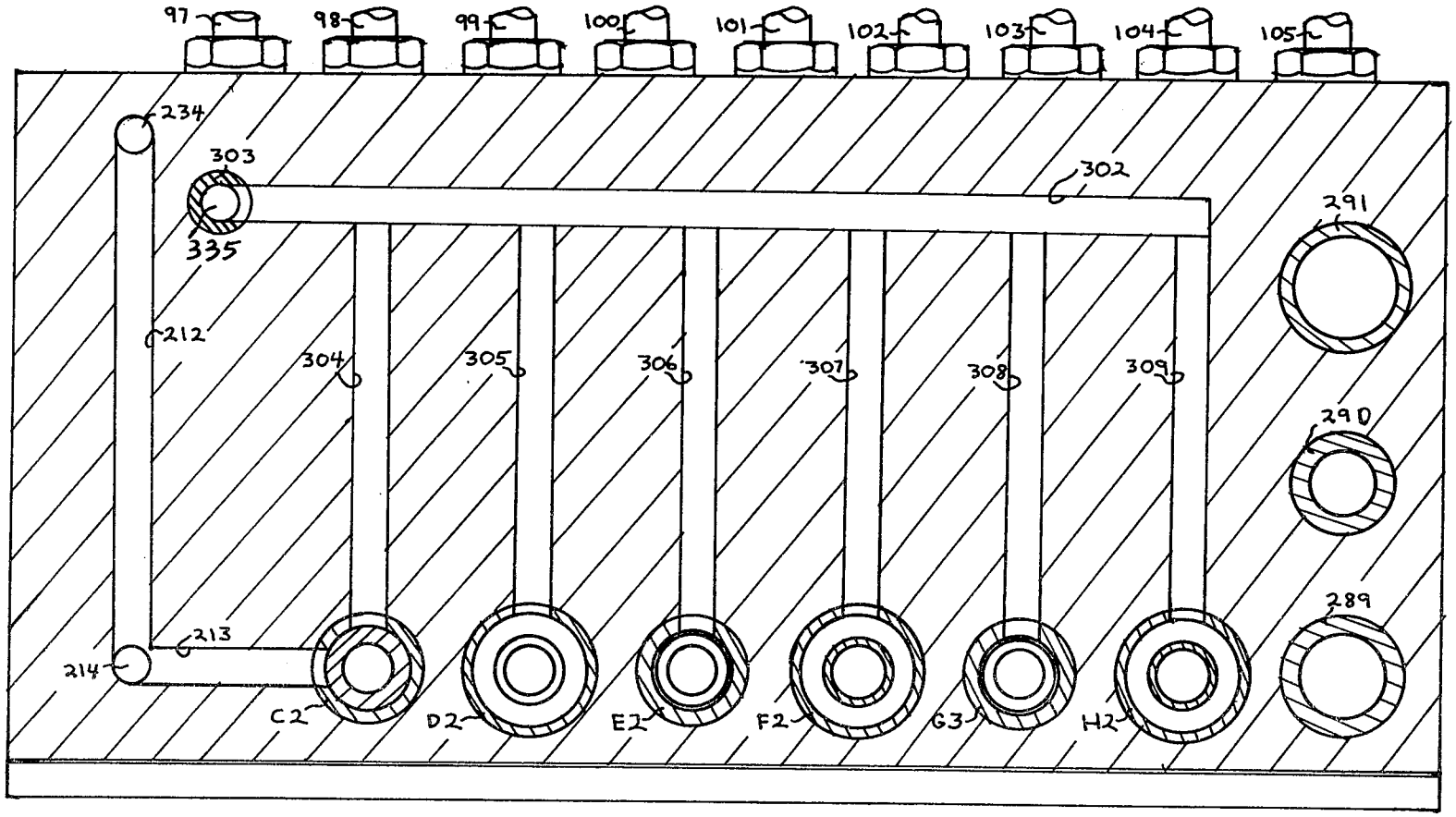
FIG. 16 is a sectional view along line M—M of FIG. 12.

The housings of the relief valves 316 and 318 at the same time serve to hold reservoir 132 tightly on the main valve body. A gasket 315 is provided underneath the reservoir wall 132 to prevent any leakage between the reservoir 132 and the valve body. Holes in the reservoir wall, through which the relief valves 316 and 318 are inserted, are sealed by plugs 324 and 326 which are provided with notches 325 and 327 for tightening by a tool. The reservoir 132 is constructed from sheet metal in a rectangular shape and it is inserted in a notch provided along the whole length of the valve body. Also, the reservoir 132 is tightened to the valve body with a bolt 337 which connects drain line 302 to reservoir 132 (see FIGS. 16 and 23). The wall of the reservoir 132, through which the relief valves 316 and 318 are inserted, is reinforced with a flat bar 323 which is welded to the inside wall of the reservoir 132 (crosswise) to accommodate the threaded hole for plugs 324 and 326.

The remaining component of section I is sliding valve I1 which consists of a cylinder 252, piston 451, and spring 418. The top part of the body 255 of the cylinder 252 is threaded into the main valve body and the bottom part 252 of the cylinder is drilled into the body. The top part of the cylinder 252 and the piston 451 are ground to a close tolerance to provide positive sealing. The returning spring 418 is partially inserted in the piston 451 and partially in the main valve body. The ends of the return spring 418 are hooked and inserted into holes 455 and 456 respectively in the main valve body and piston. This protects piston 451 from turning because a passage 256 in the piston and a passage 312 in the main valve body should be aligned. The piston 451 has a passage 254 communicating with and disposed at 90° to passage 254. The bottom part 253 of the cylinder 252 is connected to the master cylinder 203 by passages 249 and 250. When the pressurized fluid enters the valve I1, it pushes piston 451 down to the bottom 253 of the cylinder 252. Once the piston 451 sits on the bottom 253, the hole 256 in the piston 451 aligns with the passage 312 and pressurized fluid from supply line 274 flows through the passage 312 into the piston passage 256, through the vertical piston passage 254 into the passage 249 and through the passage 250 into the master cylinder 203.

When the pressurized fluid enters the master cylinder 203, it forces the piston 268 (see FIG. 15) against the spring 453 and it will push the piston 268 towards the other end of the cylinder 203 until it equalizes the pressure with the biasing force of the spring 452, which is located in the relief valve 316, and the biasing force of spring 454, which is located in the relief valve 318. Once pressure overcomes the biasing force of these two springs 452 and 454 it will flow through the relief valves 316 and 318 into the reservoir 132 and from the reservoir 132 through the line 16 into the reservoir 29.

The master cylinder 203 includes a piston 268, U-cap 271, washer 269, nut 272, post 273, post holder 270 and spring 453. The piston 268 is placed on the post 273 and on top of the piston 268 is placed U-cap 278. Inside U-cap 278 is placed the washer 269 which is tightened with the nut 272. The end of the cylinder 203 is sealed with the plug 263. The plug 263 is provided with four notches 262 which are used to tighten the plug 263. Through the centre of the plug is drilled a hole 462 to relieve the back pressure created through the movement of piston 268.

When the pressurized fluid is introduced into the master cylinder 203 it will tend to spread the U-cap 271 towards the cylinder walls and this way any possible leakage will be stopped. It should be noted that when the pump 24 is not running, the system will require pressure from the master cylinder 203 which will be created by the force of spring 453.

Figure 19:
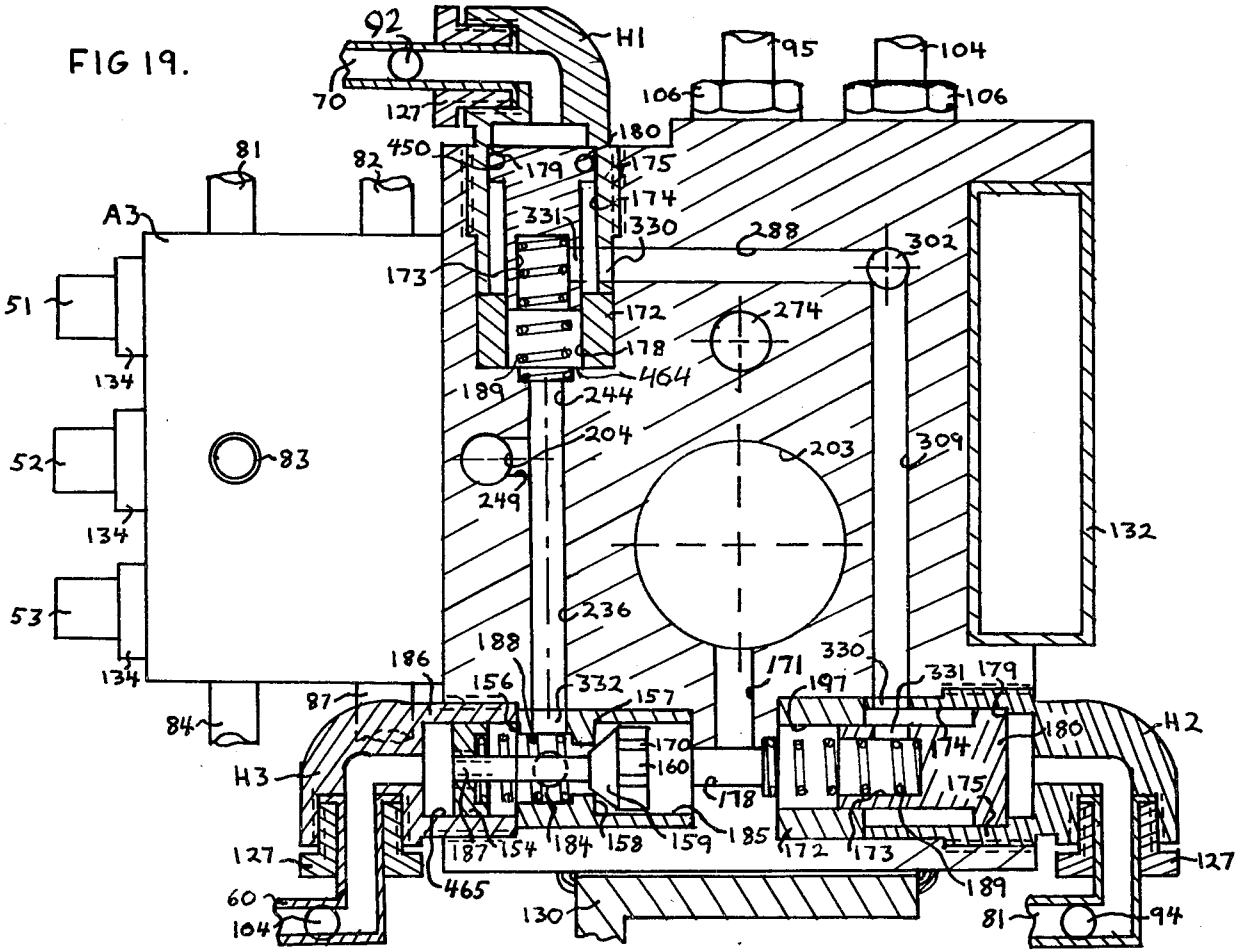
FIG. 19 is a sectional view along line H—H of FIG. 8.

As shown in FIG. 19 (a section along line H—H of FIG. 8), there are two normally open valves H1 and H2 and a normally closed valve H3. The housings of all three valves are threaded into the main valve body. These three valves H1, H2 and H3 are interconnected and H1 and H2 are connected to drain line 302 (see FIG. 16). Valve H1 is connected to the drain line 302 by the passage 288, to the valve H3 by a passage 236, and to the supply line 204 by passage 249. Valve H2 is connected to drain line 302 by passage 309, and it is connected to the master cylinder 203, by passages 171 and 178. Valve H3 is connected to the master cylinder 203 by the passages 171 and 178. It is also connected to line 193 (see FIG. 13) by passage 184, and it is connected to the supply line 204 by passages 236 and 244.

The valve H1 comprises a cylinder 174, piston 180, and a spring 189. The housing of the valve is constructed of two parts: a lower part 172 which is inserted into the main valve body, and an upper part 175 which is threaded into the main valve body. The upper part of the cylinder 174 is widened to accommodate an enlarged part of the piston 180. The landing part of the piston 180 and the bore 178, through the lower part of the housing 172, are ground to a close tolerance to provide positive sealing when the valve is in the closed position. The valve is in the closed position when pressure is introduced which forces the piston 180 down toward the bottom 464 of the bore 187. The upper part of the piston 180 is provided with an O-ring seal 450. Piston 180 has a widened top portion so that the pressurized fluid is pushing against a greater area than the area of the lower part. Upward travel of the piston is limited by a shoulder 179. The lower part of the piston 180 has a recess 173 into which a return spring 189 is partially inserted. The opposite end of the return spring bears against the main valve body. Recess 173 communicates with a hole 331 that is aligned with a hole 330 through the side of cylinder 174. Hole 330 communicates with passage 288 which is connected to the drain line 302.

The valve H2 is of the same construction and operates in the same manner as valve H1.

The valve H3 has a housing of two parts. One part 157 is inserted into the main valve body and held in position by the other part 186 which is threaded into the main valve body. The valve H3 also includes two cylinders designated respectively 185 and 465. Cylinder 185 is located in the housing part 157 and cylinder 465 is located in housing part 186. There are two pistons designated respectively 154 and 159 which are connected with a piston rod 187. The piston rod 187 and piston 159 are made of one piece and the piston rod is threaded into the piston 154. A return spring 188 is inserted partially into the piston 154 and partially into housing part 157. The pistion 159 is provided with four channels 170.

Housing part 157 has two holes designated respectively 184 and 332 through a side wall thereof, such holes being 90° to one another. When pressure is introduced into the valve H3 it will force piston 154 toward shoulder 156. At the same time, the piston 159 will slide on its sides 160, away from seat 158, which means that valve H3 will be open. When the valve H3 is open the pressure will flow from the master cylinder 203, through the passage 171, and through the passage 178, into the cylinder 185. From cylinder 185 it will flow through the four channels 170, through the passage 332 into the passage 236, through the passage 236 into the valve H1, and through the passage 249 into the supply line 204 (it will be further described that when the process of opening the lock is started, valve H1 and H2 must be closed first before valves I1 and H3 are open). At the same time fluid will flow through the hole 184 into the line 193. The supply line 193 is connected, through valves G3, F3, E3, D3 and C3, into the locking cylinder 222 (see FIGS. 13 and 14). The drain line 302 (see FIG. 16) to which are connected valves H1, H2, G1, G2, F1, F2, E1, E2, D1, D2, C1 and C2 (see FIGS. 16, 19, 20, 21 and 22) is connected to the reservoir 132. The drain line 302 is connected to the reservoir 132 by means of a bolt 303 which is threaded into the main valve body and through which is drilled passage 335 (see FIG. 23). The bolt 303 is inserted through the wall of the reservoir 132. Between the head 337 and the reservoir wall and the main valve body are two gaskets 337 and 341 to seal any possible leakage from the reservoir. The hole in the reservoir 132, through which the bolt 303 is inserted, is sealed by a plug 338 which is provided with a notch 339 in which is inserted a tool to tighten the plug and on that place the wall of the reservoir is reinforced with the flat bar 340 mounted crosswise to accommodate a threaded hole for plug 338.

Supply line 204, which is connected to valve H3 with the passages 249 and 236, is drilled lengthwise through the main valve body. When the valve H3 introduces pressurized fluid into this line it will flow from this line 204 into the three passages 343 which supplies the distributor valves A1, A2 and A3.

Figure 20:
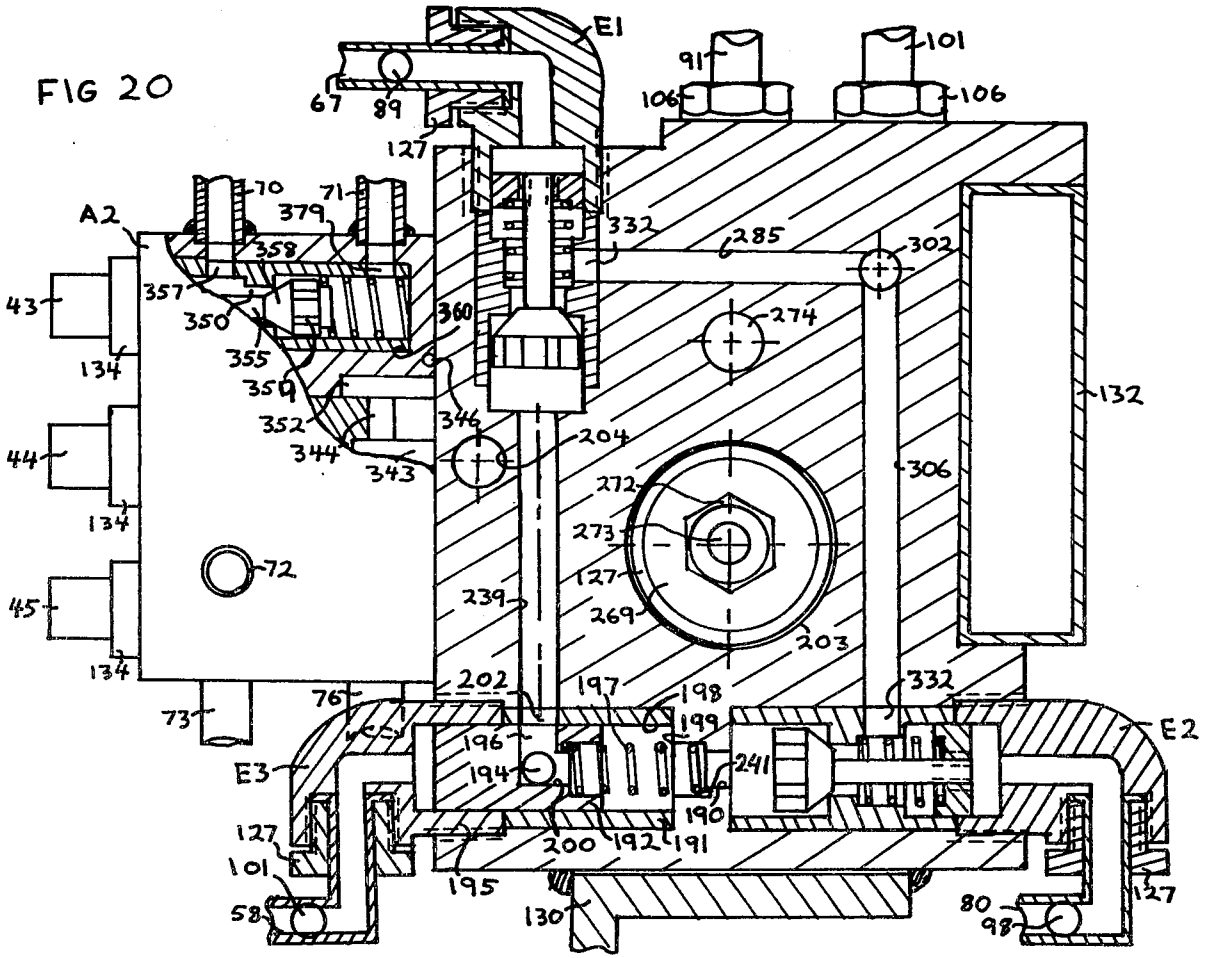
FIG. 20 is a sectional view along line E—E of FIG. 8.

As shown in FIG. 20 (a section along line E—E of FIG. 8), there are two normally closed valves E1 and E2 and one normally open valve E3. The valves E1, E2 and E3 are threaded into the main valve body in the same arrangement as the valves G1, G2 and G3 shown in section H—H (see FIG. 20). The valves E1, E2 and E3 are interconnected in the same manner as valves G1, G2 and G3 (see FIG. 20). There is no connection from either of the valves G1, G2 or G3 to the master cylinder 203 and supply line 204. Valve E1 is connected to the drain line 302 by passage 285 and valve E2 is connected to the drain line 302 by passage 306. These two valves E1 and E2 are of the same construction and work in the same manner as valve H3 (see FIG. 19). Valve E3 is threaded as at 196 into the main valve body and includes a cylinder 198, a piston 192, and a spring 197. The cylinder 198 and the piston 192 are ground to a close tolerance to provide positive sealing. The return spring 197 is partially inserted into the main valve body and partially into the piston 192. The ends of spring 197 are hooked and are inserted into holes 241 respectively in the main valve body and the piston. This is for the purpose of stopping the piston from turning because holes 196 and 202 respectively in the piston and cylinder wall should be aligned.

The body 191 of the cylinder 198 has three holes 202 drilled through the wall thereof in respective ones of three positions as shown in FIG. 14. Also, piston 192 has two holes 194 and 196 drilled through it in the same size and manner as holes 202. The piston also has a centre hole 200 which is joined with two holes 194 and 196. The lower end of the piston 192 is open and any pressure introduced in hole 194 can flow through the piston into the passage 190, which leads into the valve E2, or it will flow through the hole 196 and then through the passage 239 into the valve E1. If the valve E1 is left open it will flow through the valve into the passage 285 and into the drain line 302. If pressure is introduced into the valve E3, it will push the piston 192 toward the shoulder 199 whereupon the valve E3 will be closed, which means that further passage of fluid to the line 193 will be terminated. As shown in FIG. 13, valves C3, D3, F3, G3 are of the same construction as valve E3.

The only difference is that the valves D3 and F3, which are normally closed, have holes 194 and 196 drilled through the upper part of the piston 192, while valves E3, C3 and G3 have holes 194 and 196 drilled through the lower part of the piston 192. For example, when the pressure is introduced into the valve F3 and the piston is forced to the shoulder 199, the hole 194 should be aligned with line 193, and hole 196 should be aligned with the passage 238, which is connected to the valve F1. When pressure is introduced into the valve D3 and the piston 192 is forced to the shoulder 199, the hole 194 should be aligned with the line 193, and hole 196 should be aligned with passage 240 which is connected to the valve D1 (see FIG. 14).

The valves D1 and D2, and F1 and F2 are of the same construction and operate in the same manner as the valves H1 and H2.

The valves E1 and E2 and G1 and G2 are of the same construction and operate in the same manner as the valves H3 (see FIGS. 13 and 14).

Figure 21:
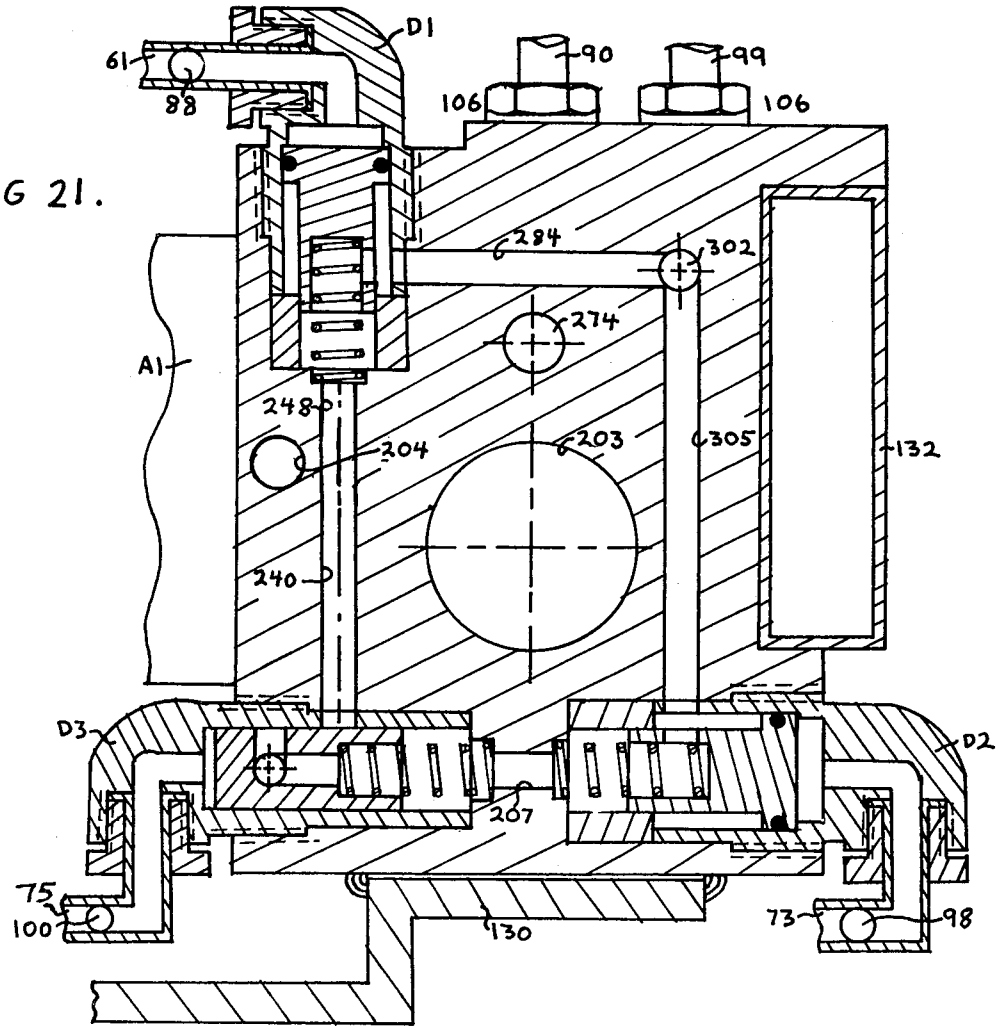
FIG. 21 is a sectional view along line D—D of FIG. 8.

The section along line F—F of FIG. 8 and along line G—G are not shown separately because section G—G is of the same construction as the section along line E—E (see FIG. 20), and the section along line F—F is of the same construction as the section along line D—D (see FIG. 21).

The section along line C—C of FIG. 8 (see FIG. 22) shows two normally closed valves C1 and C2 and one normally open valve C3. The valve C1 is connected to the return line 302 by passage 283 and to the return terminal 106 by passages 259, 235 and 234 (see FIGS. 14 and 24). The valve C2 is connected to the return line 302 by passage 304 and is also connected to the return terminal by passages 212 and 213 and is connected to the return system of the locking cylinder 222 by passage 214. Neither of these two valves have any connections with the valve C3, or supply line 204, or master cylinder 203.

Valve C1 consists of piston 232, cylinder 233 and spring 208. The spring 208 is partially inserted into the main valve body and partially into the piston 232. The ends are hooked so that the hooked part of the spring is inserted into holes 116 respectively in the main valve body and the piston. This is for the purpose of stopping the piston from turning because holes 231 and 235 and holes 230 and 334 should be aligned.

Figure 22:
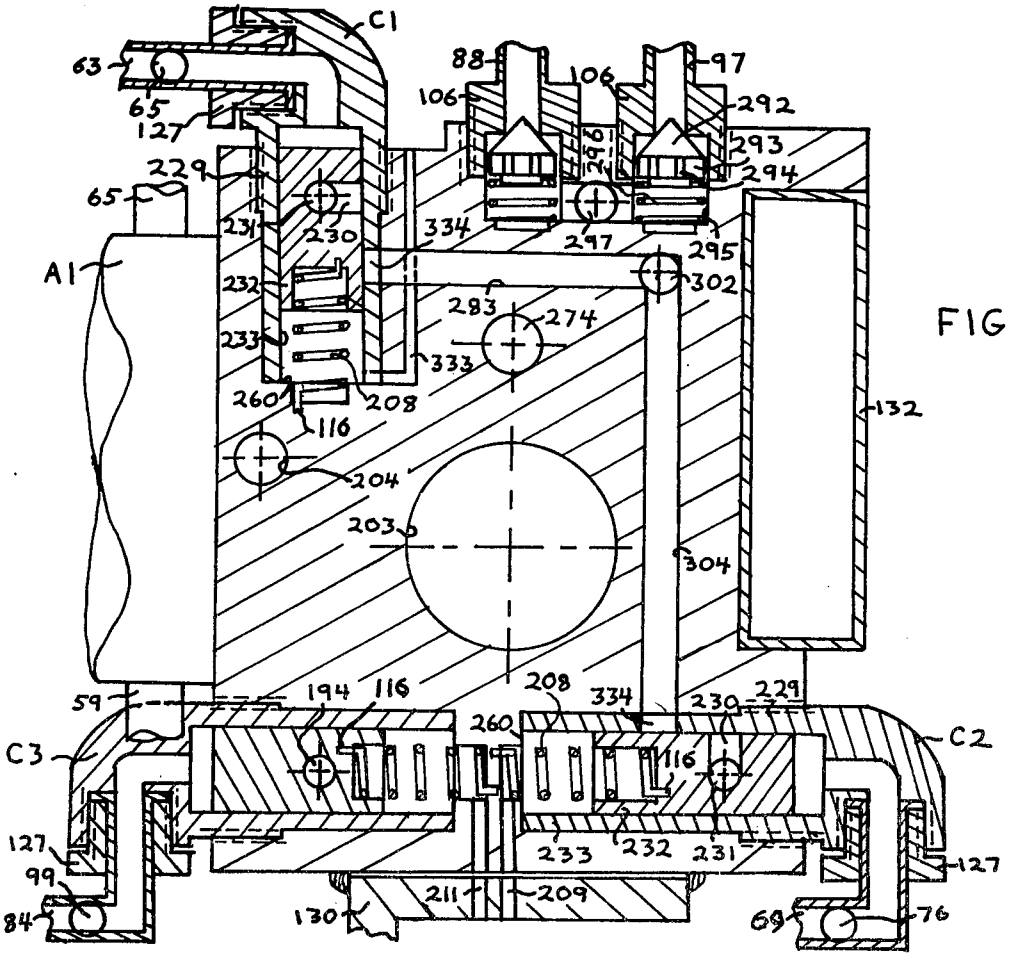
FIG. 22 is a sectional view along line C—C of FIG. 8.

At the very end of the cylinder 233 there is provided a passage 333 in the main valve body for relieving back pressure created through movement of the piston 232 (see FIG. 22). The body of the valve is threaded, as indicated at 229, into the main valve body and like all the other valves, the landing part of the piston and cylinder are ground to a close tolerance to prevent any possible leakage.

When the pressure re-enters valve C1, it will force piston 232 down the cylinder 233 against the force of spring 208 toward the bottom 260. When the piston 232 sits on the bottom, the piston hole 231 will be aligned with hole 335 which extends through the cylinder 233 (see FIG. 14). Hole 335 communicates with passage 259. The piston 232 also has another hole 230 which is drilled through the piston 232 at a 90° angle to hole 231. This hole 230 is matched with another hole 334 which is drilled through the cylinder 233 and communicates with passage 283 (see FIGS. 14 and 22). When the pressure is introduced into the valve C1 and the piston 232 is pushed down to the bottom then the hole 231 in the piston will be aligned with the hole 335 and, at the same time, hole 230 is in alignment with hole 334 which communicates with passage 283. The valve C1 is then in the open position and the return terminal 106 is also open.

Return terminal 106 consists of eighteen small check valves (see FIGS. 17, 15 and 22). Each check valve consists of a piston 292, a spring 296 and a cylinder 295. The cylinder 295 consists of two parts: a lower part which is drilled into the main valve body and an upper part threaded into the main valve body. The piston has four channels 294 through which fluid flows and the piston slides in the bore of the cylinder on its sides 293. The upper part of each cylinder has a nipple on which are connected the return lines. Also the upper part of the body of the cylinder of each check valve is shaped in a hexagon for easy installation by a tool (see FIG. 9). On these eighteen check valves are connected seventeen return lines from seventeen different ones of the slide valves, namely D1 is connected to the return terminal by line 88; E1 by line 89; F1 by line 90; G1 by line 91; H1 by line 92; I1 by line 93; H2 by line 94; G2 by line 95; F2 by line 96; E2 by line 97; D2 by line 98; C3 by line 99; D3 by line 100; E3 by line 101; F3 by line 102; G3 by line 103; H3 by line 104; and the line 105 which is connected to the line 152. The reasons for all of these return lines having a check valve at its end is to stop passage of pressure from one line to another.

The return terminal also has a line 297 which is drilled lengthwise in the main valve body and such line 297 is connected to each check valve by respective ones of passages 296. Line 297 is always pressurized because every one of the return lines are connected together with the supply line of the valve and when pressure is introduced from the distributor valve into any of these seventeen sliding valves, the return line of that valve at the same time is pressurized. The pressure through that return line will go through that check valve into the line 297. The check valves on the end of the other lines, which are connected to the terminal, will block any pressure from entering into the other return lines. If no check valve were to be installed on the other end of the return lines, pressure which enters through one return line into the line 297 would enter the other return lines, pass into another valve, and it would then close or open the valves which should not be closed or open at that time. With these check valves installed on the end of each return line, the pressure is forced to stay in the line 297 until valves C1 or C2 or both are open.

Valve C2 is of the same construction as valve C1, and the return lines from these two valves are not connected to the return terminal but instead to the distributor valves. The return line 65, which is connected to valve C1, has its other end connected to the distributor valve A1 (see FIG. 8).

Figure 10:
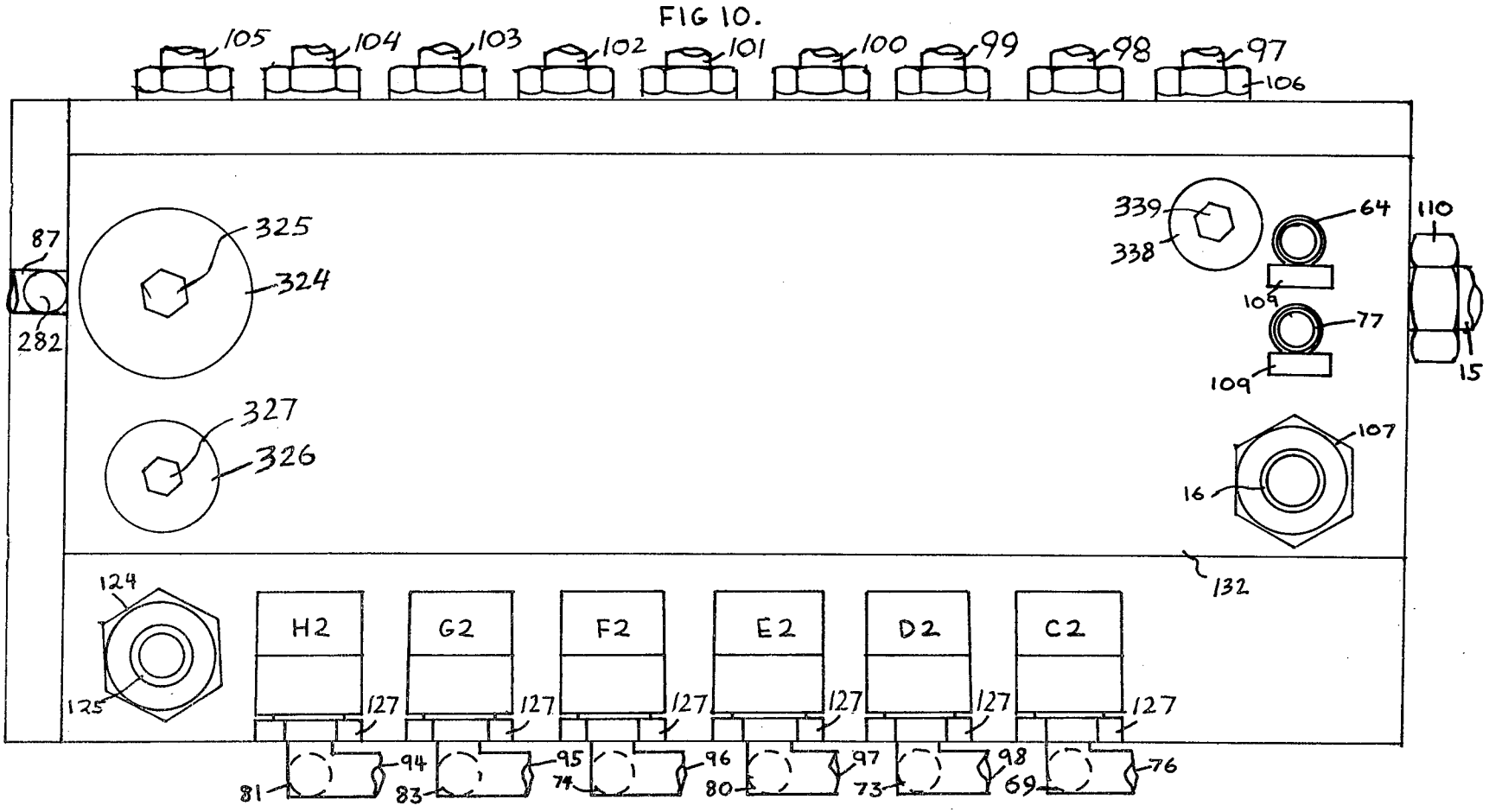
FIG. 10 is a rear elevational view of the lock valve assembly shown in FIG. 2.
Figure 11:
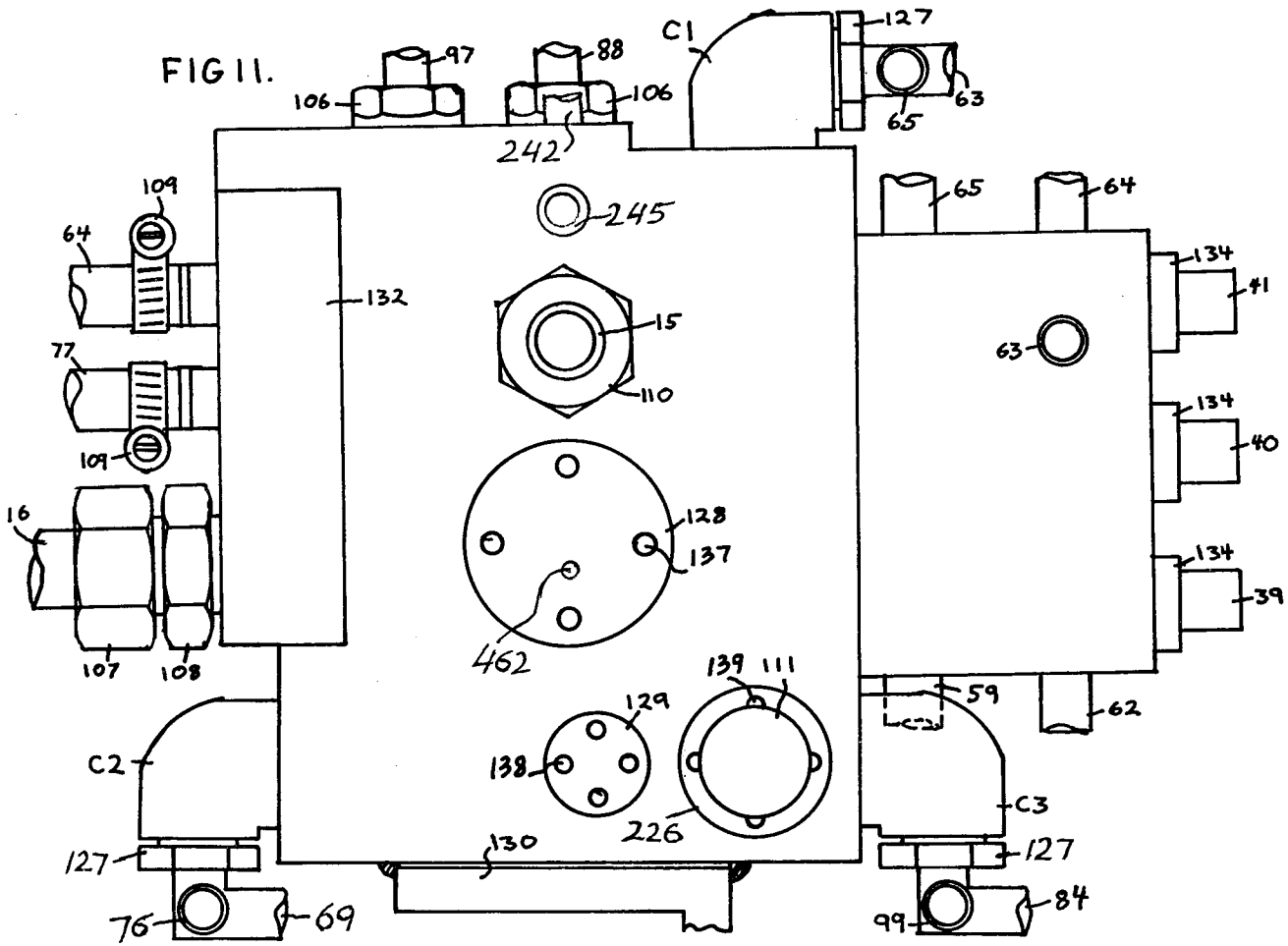
FIG. 11 is a bottom view of the valve assembly of the lock shown in FIG. 1 and taken as a left side elevational view of FIG. 8 as shown on the sheet.

When valve 41 of distributor valve A1 is pressed, spring 208 of valve C1 acting against piston 232 forces fluid through the return line 65 into the distributor valve A1 and through the distributor valve into the line 64. The line 64 has its other end connected to the reservoir 132 (see FIGS. 10 and 24). When valve 42 of the distributor valve A2 is pressed, the pressure which flows through the line 69, which has the other end connected to the valve C2, will enter the valve C2, and the valve will open. The return line 76, which is connected to the valve C2, has its other end connected to the distributor valve A2. When valve 48 of the distributor valve A2 is pressed, spring 208 acting against piston 232 of valve C2 forces the fluid through the return line 76 into the distributor valve A2 and from the distributor valve A2 it will go through the line 77 into the reservoir 132. At this point the valve C2 will close (see FIGS. 10 and 24).

As previously described, the distributor valves A1, A2 and A3 each consist of eight small valves and thus there are twenty-four in all. Four of these valves are supplied with pressure directly from the pump through the terminal 282 via lines 59, 82, 71 and 87 (see FIG. 12). Sixteen of the valves are supplied from the chamber 352 (see FIG. 23). Valve 41 on the distributor valve A1, and valve 48 on the distributor valve A2 are not supplied with fluid at all. These two valves are of the same construction and operate in the same manner as the other valves described with reference to FIG. 23 and are connected to the return lines of the valves C1 and C2. Should it occur that valves C1 or C2 are open, valves 41 and 48 will release the pressure so that they will close. When valve 41, or valve 48 is pressed, the fluid will enter through the respective lines 65 and 76, as the case may be, pass through the valves and by lines 64 or 77 return to the reservoir 132 (see FIGS. 10 and 24). This arrangement of the valves C1 and C2 is mainly for the purpose of locking the vault door (which will be described further hereinafter), and for the purpose of putting all the other valves in their original position by releasing the pressure which may have been introduced into any of the valves by mistake. To correct such a mistake it is only necessary to press the valve 40 on the distributor valve A1 which will open valve C1 and press valve 42 of the distributor valve A2 which will open valve C2. When the valves C1 and C2 are open, the pressure from the return terminal will flow through the line 297 into the passage 234, and from the passage 234 into the passages 212 and 235, through the passage 235 into the passage 259, through the passage 259 into the valve C1, from the valve C1 into the passage 283, into the return line 302, through the return line 302 and into the reservoir 132. At the same time, fluid will flow through the passages 212 and 213 into the valve C2, through the valve C2, into the passage 304, into the return line 302, through the return line 302 and into the reservoir 132 (see FIGS. 14, 22, 24, 17, 8 and 16 and 23).

When the pressure is drained from the return terminal 106, then all the valves will return to their normal position except the valves C1 and C2. The valves C1 and C2 will be returned to their normal position by pressing valves 41 and 48 of distributor valves A1 and A2. When these two valves are pressed, the pressure which has forced the pistons into the open position will be released through the lines 64 and 77, into the reservoir 132.

The sixteen sliding valves which are supplied with pressure from chamber 352 through the distributor valves A1, A2 and A3 (see FIGS. 8 and 23) are connected from the distributor valves as follows: the valve 34 is connected by line 66 to the sliding valve G1; valve 35 is connected by line 67 to valve E1; valve 36 is connected by line 58 to valve E3; valve 38 is connected by line 61 to valve D1; valve 39 is connected by line 62 to line 152 which supplies the alarm trigger; valve 44 is connected by line 72 to line 152 which supplies the alarm trigger; valve 45 is connected by line 73 to valve D2; valve 46 is connected by line 74 to valve F2; valve 47 is connected by line 75 to valve G1; valve 49 is connected by line 68 to valve G3; valve 50 is connected by line 80 to valve E2; valve 52 is connected by line 83 to valve G2; valve 53 is connected by line 84 to valve C3; valve 54 is connected by line 85 to valve F1; valve 56 is connected by line 78 to valve F3; valve 57 is connected by line 79 which is connected to line 152 which supplies the alarm trigger.

The four valves which are supplies from the supply terminal 282 (see FIGS. 12 and 15) are as follows: valve 37 is connected by line 59 to supply terminal 282 and by line 60 to the valve H3; valve 43 is connected to supply terminal 282 by line 71 and by line 70 to valve H1; valve 51 is connected to supply terminal 282 by line 82 and by line 81 to the valve H2; valve 40 is connected by line 63 to valve C1 and by line 242 to supply passage 470; valve 42 is connected by line 69 to valve C2 and by line 245 to passage 470; and valve 55 is connected to supply terminal 282 by line 87 and by line 86 to valve I1.

The remaining two valves are connected as follows: valve 41 is connected by line 65 to valve C1 and is connected by line 64 to reservoir 132; and valve 48 is connected by line 76 to valve C2 and by line 77 it is connected to the reservoir 132. All said lines are of plastic hose and, if it is not otherwise preferred, all the connections are made by means of hose clamps 109 (as shown in FIG. 24).

As shown in FIG. 8, the small valves of which the three distributor valves A1, A2 and A3 consist, are placed in equi-spaced relation in a circle in the respective distributor valves.

The small valves, arranged in a circle, are engageable by a pin 119 projecting from a rotatably mounted disc 120 (see FIG. 23). When the disc 120 is pushed inwardly, pin 119 actuates the valve located in alignment with such pin opening such valve.

The disc 120 is mounted on one end of a drum 390 by a bolt 118 and keyed as indicated at 362 to ensure that the disc turns with the drum. Key 362 is partially inserted into the drum 390 and partially into the disc 120.

Figure 27:
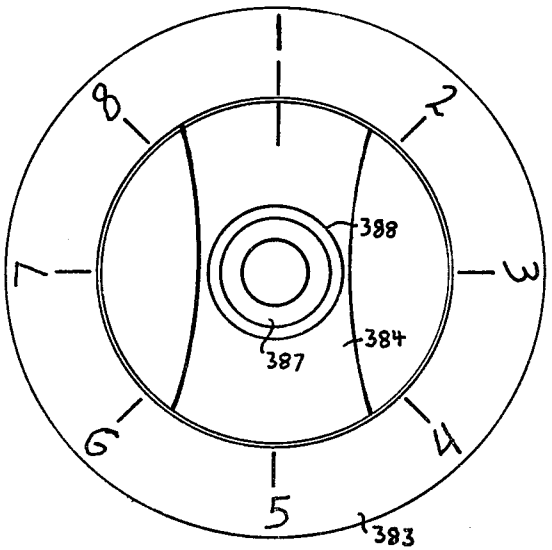
FIG. 27 is a front elevational view of one of the dials for actuating the valve and number plate mounted on the front face of the door.
Figure 25:
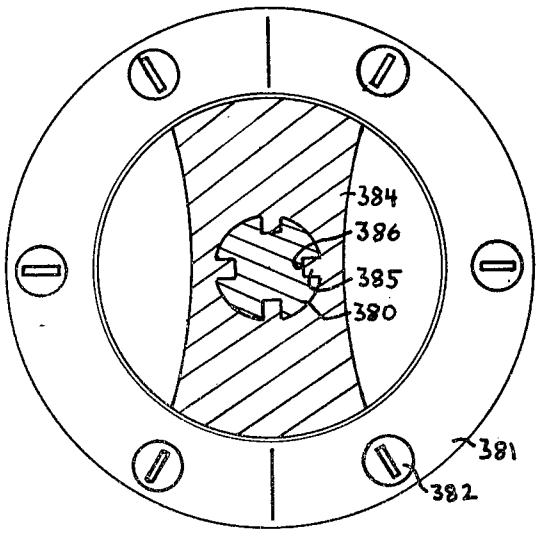
FIG. 25 is a sectional view along line X—X of FIG. 26.
Figure 26:
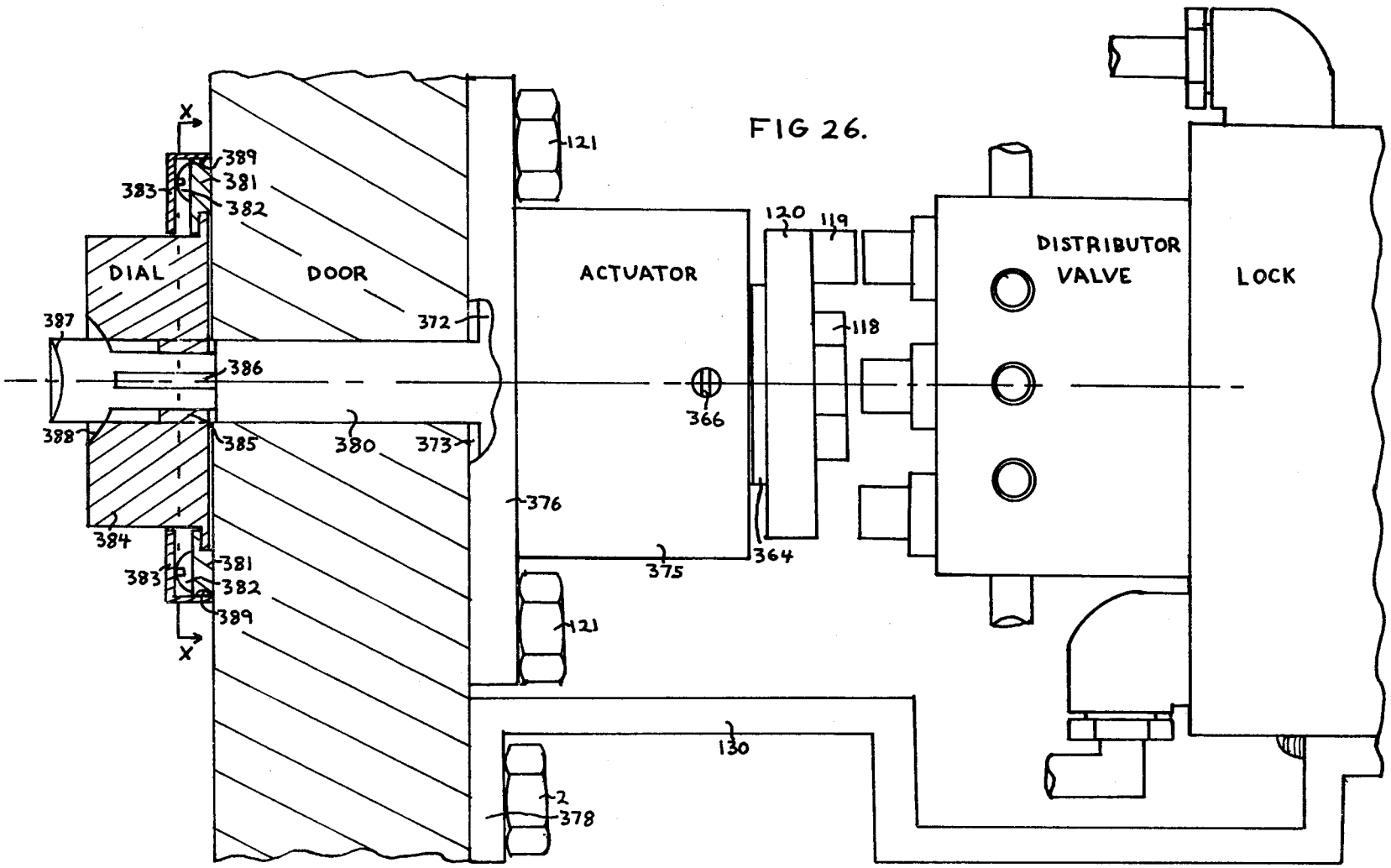
FIG. 26 is a top plan view, in partial section, showing the valve assembly and actuator mounted on the rear face of the door.

The drum 390 has eight grooves 370 disposed in equicircumferential relation on the outer surface thereof and in which slides a spring loaded ball 365. The drum 390 is rotatively mounted in a housing 375. The drum 390 has an enlarged portion 374 located to the left of the grooves as viewed in FIG. 23 and at the end of which there is an outwardly directed flange 371. The flange 371 serves as an abutment for a compression spring 368 which, at the other end, bears against the housing 375. A shoulder 372 on the end of the drum 390 engages a spacer 373 located on the rear face of the vault door. A shaft 380, made from the same piece of material as drum 390, passes through the vault door and connected thereto is a finger operated dial 384 located on the front face of the vault door. The shaft 380 has four rectangular notches 386 (see FIG. 25) in which are inserted rectangular bars 385 formed in the body of the dial 384. The dial 384 turns together with the shaft 380, and when the shaft 380 is pressed in, the rectangular bars 385 slide in the rectangular notches 386. The ring 381 holds the dial 384 in place against the vault door and is fastened thereto by screws 382. The dial 384 is free to turn underneath the notched part of the ring 381. The ring 381 (see FIG. 26) has a groove 389 extending circumferentially around the outer surface. A face plate 383 has on its inside face a rib that snaps into the groove 389, holding the face plate 383 on the ring 381. The face plate 383 has numbers 1 to 8 marked on its outside face (as shown in FIG. 27) corresponding to the number of valves of the distributor valve associated therewith.

Figure 31:
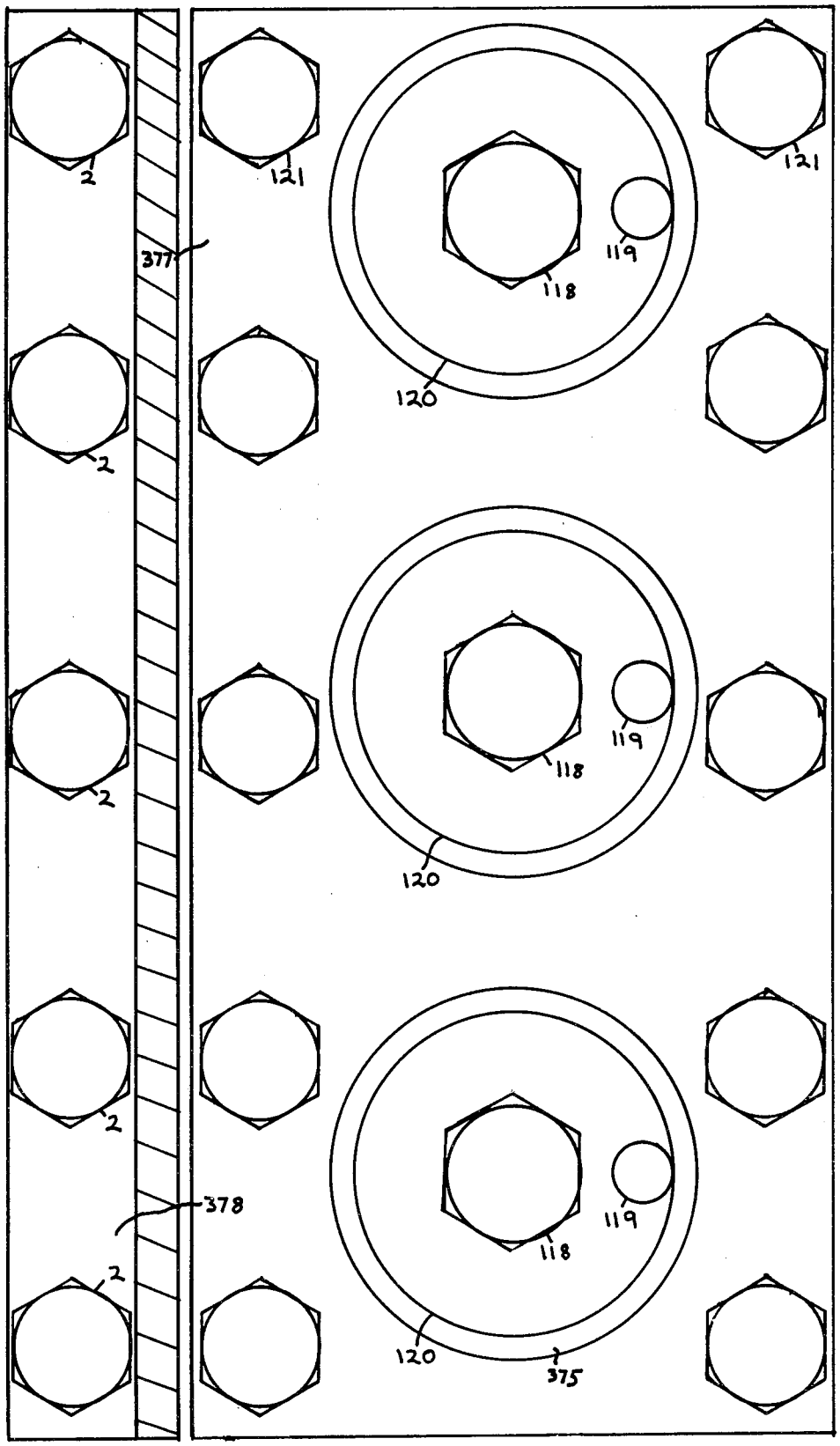
FIG. 31 is a rear elevational view of the three valve actuators mounted on the rear face of the vault door.

When the dial 384 is turned, shaft 380 rotates therewith moving pin 119. Shaft 380 is provided with an indentation 387 at its free outer end to accommodate a thumb or finger for pressing on the shaft to move it axially to the right as viewed in FIG. 23 against the pressure of spring 368. If shaft 380 is pressed in, the dial 384 stays in place. Shaft 380 slides through dial 384 until the enlarged part 374 of the drum 390 abuts against shoulder 369 of the housing 375. At the same time, the pin 119, when aligned with one of the valves of the distributor valve associated therewith so that by turning the dial to each of the different numbers a different one of the valves will be actuated, presses the push bar in, opening the valve. The numbers on the face plate and a line on the dial are correlated with the position of pin 119 and the valves. When shaft 380 is released, the biasing force of the spring 368 returns the shaft to its original position shown in FIG. 23. The spring loaded ball bearing 365 holds the drum 390 locked in position for each of the numbered positions. When the dial is turned from one numbered position to another, the ball bearing 365 is forced to move against the pressure of spring 367 which pressure can be varied by a set screw 366. Every time the line or index on the dial 384 lines up with a number on the face plate, the spring 367 will push ball bearing 365 into one of the grooves 370. This way, when the dial 384 is dialed to any numeral, the drum will stay locked in that position. The housing 375 is circular and made of one piece and is welded 377 into the plate 376. The plate 376 is bolted to the vault door with ten bolts 121, as shown in FIG. 31. Since there are three distributor valves in the embodiment shown, three dial actuators are required, one for each distributor valve.

The actuators are mounted on the door before the lock is mounted on the door. The lock is mounted on the door in such a way that the exact centres of the actuators match the exact centres of the distributor valves (see FIG. 23).

The main valve body is welded to a bracket 130 which is attached to the rear face of the vault door by five bolts 2 (see FIGS. 23 and 31).

An electric switch (not shown), which starts the motor 25 to drive pump 24, is mounted outside of the vault door at any convenient place. Before the vault door can be unlocked, it is necessary to turn the switch on so that the pump will start building up pressure for the system. The pump outlet line 15 is connected to the main valve body and, when pressurized, piston 264 is pushed away from valve seat 261 (which is separately threaded into the body of the lock) against the pressure of spring 278. The piston 264 slides on its sides in cylinder 280, the end of which communicates with a passage 470 to which are connected lines 242 and 245. Line 242 has its other end connected to valve 40 of distributor valve A1, and line 245 has its other end connected to valve 42 of distributor valve A2. The pressurized fluid flows through the four channels 266 on the sides 265 of the piston 264. Once the pressure passes through this check valve 264, it flows through supply line 274, through another check valve 275 of the same description, and it flows into a short pipe 282 (supply terminal) to which are connected lines 59, 82, 71 and 87. The purpose of supply terminals 282 being installed at the end of line 274 is to have valves 37, 43, 51 and 55 receiving a supply of pressurized fluid directly from line 274. Since at this time the output of the pump 24 is not being used, the pressure flows through a release valve 316 into reservoir 132.

In order to introduce pressure into master cylinder 203 and into the rest of the valves, it is necessary to turn the dial #1 (see FIGS. 2, 8 and 27) to the numeral two which appears on the face plate 383 and press in the shaft 380 which will actuate valve 51 of distributor valve A3, opening the same. The pressure will flow through line 81 into the valve H2 closing the same.

After valve H2 has been closed, it is necessary to close valve H1. This is accomplished by turning dial #2 to the numeral 2, which appears on face plate 383, and pressing the shaft 380 which will actuate valve 43 of distributor valve A2 opening the same. Pressure will flow through the line 70 into valve H1 closing the same.

All sliding valves of the distributor valves are actuated by turning the dials 384 associated therewith to the desired numerical position and then pressing the shaft.

After valve H1 has been closed, valve I1 should be opened. Dial #1 is turned to numeral six and, when the shaft is pressed, valve 55 opens and pressure will flow through the line 86 into the valve I1 which will then open.

When the valve I1 is opened, the pressurized fluid from line 274 will flow through valve I1 into a master cylinder 203. Once the pressure in master cylinder 203 is built up in excess of the required psi, the relief valve 318 will then open and pressure will flow through it into reservoir 132.

After valve I1 has been opened, valve H3 should be opened. To do this dial #3 is turned to numeral four and, when the shaft is pressed in, valve 37 is opened and pressure will flow through line 60 into valve H3 which will then open. Pressure from master cylinder 203 will then flow through valve H3 into line 193 and to supply line 204. From this point the remainder of the sliding valves (except C1 and C2) will be supplied with pressure from chamber 352 which communicates with the supply line 204.

Because of the limited intake of valve H3, it is important that all the valves, which are connected to the drain line 302, be closed before any of the valves, which are normally closed, are opened. The pressure, instead of entering line 193 and supply line 204, would flow through the valve H1 into the drain line 302. This would cause an absence of pressure in supply line 204 which supplies the necessary pressure to the distributor valves A1, A2 and A3. Should this occur, the remainder of the valves could not be opened or closed.

If the volume of the pump is sufficiently large, only valves C1 and C2 can be closed because it is activated by pressure coming directly from the passage 470 but, if it occurs that valve F2 is not closed before valve F3 is opened, the whole process must be started over again since there would be no pressure remaining in supply line 204 to activate this valve.

As previously described, in such a case valves C1 and C2 would have to be opened because valves C1 and C2 are activated by pressure directly from supply passage 470. To open valve C1, dial #3 is turned to numeral seven and, when the shaft is pressed in, valve 40 of the distributor valve A1 will open and pressure will flow through line 63 into valve C1 which will then open. To open valve C2, dial #2 is turned to numeral one and, when the shaft is pressed in, valve 42 will open and pressure will flow through line 69 into the valve C2, which will then be open. When the valves C1 and C2 are open, the return terminal is also open and, since all the valves are connected to the return terminal, the returning springs of the sliding valves push the pistons and the pistons force the fluid into the return terminal. From the return terminal fluid will flow through the valves C1 and C2 into the return line 302.

When the pressurized fluid is drained out from all the valves, these valves will return to their original position. This also includes valves H1, H2, H3 and I1.

In order to start the process of activating the valves again, valves C1 and C2 must be closed first, otherwise pressurized fluid introduced into any of the valves would go directly to the return terminal and from the return terminal through valves C1 and C2 into drain line 302.

Valve C1 is closed by turning dial #3 to numeral eight and, when the shaft is pressed in, valve 41 of distributor valve A1 will open and fluid will be forced out by the piston, which is pushed by the return spring through line 65 into valve 41, and from valve 41 through line 64 into reservoir 132.

In order to close valve C2, dial #2 is turned to numeral seven and, when the shaft is pressed in, valve 48 of distributor valve A2 will open. The returning spring will push the piston which will force the fluid out from valve C2 through line 76 into valve 48 and from valve 48 through line 77 into reservoir 132.

When these two valves C1 and C2 are closed again, then sliding valves H1 and H2 can be closed while valve I1 can be opened and valve H3 can also be opened. The pressurized fluid coming through valve H3 into line 193 will flow through valve G3 because valve G3 is normally open. If the pressure were to be introduced into valve G3 by mistake, which means by dialing the wrong numeral, valve G3 would be closed and the process, which has been previously described, would have to be done again, otherwise pressure would have no way to pass further into line 193. The same holds true for valves E3 and C3 or, if the valve G3 is left in the open position and valves G1 or G2 had been dialled by mistake, the pressure would go out into the drain line 302. In order to close valves G1 or G2 again, the previously described process would have to be started again. The same holds true for valves E1 and E2.

When pressurized fluid flows though valve G3 into line 193, then valves F1 and F2 have to be closed before valve F3 is opened.

Valve F1 is closed by turning dial #1 to numeral five and, when the shaft is pressed in, valve 54 of distributor valve A3 will open and fluid will flow through line 85 and into valve F1 which will then close.

When the dial #2 is turned to numeral five and the shaft is pressed in, valve 46 of the distributor valve A2 will open and fluid will flow through line 74 into valve F2, which will then close.

When dial #1 is turned to numeral seven and the shaft is pressed in, valve 56 of the distributor valve A3 will open and fluid will flow through line 78 into valve F3 which will then open.

When valve F3 is open, pressurized fluid will flow through valve F3 into line 193 and through valve E3 into line 193 again. That is, if valves E1, E2 and E3 have not been dialled.

When the dial #3 is turned to numeral five and the shaft is pressed in, valve 38 of distributor valve A1 will open and fluid will flow through line 61 into valve D1 which will then close.

When the dial #2 is turned to numeral four and the shaft is pressed in, valve 45 of distributor valve A2 will open and pressurized fluid will flow through the line 73 into valve D2 which will then close.

When the dial #2 is turned to numeral six and the shaft is pressed in, valve 47 of distributor valve A2 will open and pressure will flow through line 75 into valve D3 which will then open.

When the valve D3 is open, pressure will flow through valve D3 into line 193 and through valve C3 again into line 193, and through line 193 into locking cylinder 222.

The locking cylinder 222 consists of piston 221, which has its narrower end 225 sliding through gland nut 226, and gland nut 226 is provided with an O-ring seal 224. The enlarged part of the piston 221 slides inside cylinder 222 and is provided with an O-ring seal 223. The body of the cylinder 222 is inserted into the main valve body and is retained therein by the gland nut 226 which is threaded as indicated at 224. A passage 220 from the cylinder 222 communicates with a passage 218 having therein a check valve 217. The rod portion of piston 221 has a flange 111 threaded as at 257 into the free end thereof. A small passage 258 which leads to the outside of the main valve body of the lock from the cylinder 222 serves the purpose of relieving back pressure created through the movement of piston 221.

When fluid pressure enters cylinder 222, piston 221 moves toward the gland nut 226 and, via flange 111, spool 416 of slave valve 20 is moved against the force of spring 400. When piston 221 is in abutting relation with the gland nut, passage 393 in the spool is aligned with passages 30A and 30B in the slave valve. The purpose of having piston 221 engage gland nut 226 is to stop the piston 221 from pushing the spool 416 too far. When pressure is released from cylinder 222, spring 400 returns the spool 416 to its normal position, at which position flange 111 abuts gland nut 226. This ensures alignment of passage 394 in spool 416 with passages 31A and 31B in the slave valve 20. When passage 393 of valve 20 is in alignment with passages 30A and 30B, fluid pressure from the pump, via line 30, passes into chamber 412 from which it is divided amongst the four cylinders 18, 19, 23 and 27 as previously described, retracting the locking pins and thus unlock the vault door.

When the vault door is to be locked, it is required that valves C1 and C2 be open.

As previously described, valve C1 is opened by turning dial #3 to numeral eight. To open valve C2, dial #2 is turned to numeral seven. When valves C1 and C2 are opened, the pressurized fluid, which has been introduced in the valves, will be pushed out of the valves by the return springs into return terminal 282 and into drain line 302. At the same time, spring 400 of slave valve 20 returns spool 416 to its normal position and in so doing causes piston 221 to force fluid through the passages 220 and 218 into the check valve 217. The force is sufficient to open the check valve. Once the fluid has passed through the check valves 217, it passes through the passage 214 into passage 213. When the valve C2 is open, hole 231 therein is aligned with passage 213 providing an open path to drain line 302.

The alarm trigger is for the purpose of stopping a person, who does not know the combination, from dialing random combinations in an attempt to open the lock. This is accomplished by having one valve from each distributor valve A1, A2 and A3 connected to the alarm trigger.

When the dial #1 is turned to numeral eight and the shaft is pressed in, valve 57 of distributor valve A3 will open and pressure will flow through line 79 into line 152, which activates the alarm trigger.

When the dial #2 is turned to numeral three and the shaft is pressed, valve 44 of distributor valve A2 is opened and pressure flows through line 72 into line 152, and the alarm trigger will be activated.

When the dial #3 is turned to numeral six and the shaft is pressed in, valve 39 of the distributor valve A1 opens, and pressure will flow through line 62 into line 152, and then the alarm trigger will be activated.

It should be noted that this lock cannot be opened without electrical power (unless it is provided with a manual pump). In order to get any pressure into the lock system, the pump 24 must be started first and, if electrical power was to be cut off in order to eliminate the alarm system, the lock automatically cannot be opened.

The alarm system should be supplied with electrical power from the same line as motor 25 so that, when the motor is turned on, the alarm system is automatically energized. Therefore, it is very difficult to cut off power for the alarm without doing so for the pump at the same time.

If a manually operated pump is used, it may be installed at any convenient place outside the vault door. The outlet from the manually operated pump should be connected to line 15 and the inlet line to reservoir 29.

If the manually operated pump is connected as described, it will build pressure into master cylinder 203 through check valves 264 and 275.

When the pressure enters master cylinder 203 from the manually operated pump, it will press piston 269 against spring 453 until it equalizes the biasing force of the spring 454, which is provided in relief valve 318, with the biasing force of spring 453.

Once this is accomplished, there should be a sufficient amount of pressurized fluid in master cylinder 203 to force piston 221 of cylinder 222 which opens the slave valve 20.

However, if the combination is not dialed correctly, it may be required that the master cylinder 203 should be pressurized again.

If the manually operated pump is connected to line 15, there is no need to connect the pump to supply terminal 282 because supply terminal 282 will be supplied from line 274 as is the case when the pump is electrically driven.

In order to protect cylinders 18, 19, 23 and 27 and the rest of the system from excessive pressure from pump 24, a safety valve 439 is provided. The safety valve 439 is connected on the outlet line 15 of the pump 24. The other end of safety valve 439 is connected to the reservoir 29 with line 440. The pressure set of safety valve 439 is determined by the required pressure of the system.

If desired, more than one door can be supplied by pressurized fluid from one central pump.

The outlet of the central pump should be connected to line 125, which is connected to check valve 141. It should also be connected to the supply terminal 282 and to the line 30, which is connected to the slave valve 20.

The purpose of the two check valves 264 and 275 being installed one on each end of the line 274 is as follows: Because of the conical shape of the valve portion, the load on the pump 24 will be constant as flow through the valves will be constant at all times because the spring 278 should have the same biasing force as that of the spring 452, which is provided in the relief valve 316.

If the biasing force of the said two springs is the same as the biasing force of springs 278, which are provided in check valves 264 and 275, the load demand on the pump will be the same at all times.

If the said springs are not of equal biasing force, loads on pump 24 would vary and the noise made by the pump would also change every time relief valves 316 and 318 are opened, giving an indication of the openings or closings of valves inside the lock.

Also, if an attempt is made to hear the movement of fluid inside the lock through a listening device, check valves 264 and 275 produce a constant noise caused by the flowing of fluid, thereby drowning out any distinctive noise of the movement of fluid inside the lock.

A further safety feature of this locking system is intended to prevent someone from introducing outside pressure into cylinders 18, 19, 23 and 27, which would pull in the locking pins, as was previously described. One way to introduce external pressure into these four cylinders is to drill four holes through the vault door, and through the body of cylinders 18, 19, 23 and 27, on the opposite side of their intake holes and then introduce outside pressure into the cylinders. To prevent the drilling of holes at these four places, four ball bearings 437 are provided. There is a ball bearing for each cylinder located at a position opposite to its intake hole. The ball bearings 437 should be free to turn, thus making it difficult to drill a hole because, when the drill comes into contact with the ball bearing, the ball bearing will turn together with the drill bit.

The combination to open the lock can be made shorter or longer, as desired, by changing the valves from the normally open position to a normally closed position or from a normally closed to an open position. The combination can also be changed by interchanging the connections.

The combination for locking the vault door stays the same at all times and is effected by actuation of only valves C1 and C2. Pressure for locking the system comes from master cylinder 203 and the pump does not have to run while the system is being locked. This is because, while the door is being unlocked, the pump is running which builds up pressure in the master cylinder 203 pressing piston 368 against spring 453 until the required pressure of the system has been reached and until the relief valves 316 and 318 have been opened, which means that fluid is always pressed by the spring 453 while the pump is running and while the pump is not running. When the system is to be locked, the fluid inside the master cylinder 203, which is pressurized by the spring 453, will flow through the check valve 479 into the lines 128 and 137, as shown in FIG. 15, and said lines 128 and 137 are joined respectively with the line 242 of distributor valve A1 and line 245 of distributor valve A2.

Because line 128 is joined together with the line 242, the valve C1 will be activated by the pressure coming from the master cylinder 203, through check valve 479, and because line 137 is joined with the line 245, the valve C2 will be activated by pressure coming from the master cylinder 203 through the check valve 479. This way the pump does not have to be running while the combination is dialed to lock the door since the spring 453 will cause sufficient fluid pressure to actuate the valves C1 and C2 and, if the pump is running, the valves C1 and C2 will be supplied only by pressure coming directly from the pump through the supply passage 470 because, when the pressurized fluid which comes through passage 470 enters the lines 242 and 245, it will also enter the lines 128 and 137 and will tend to go through the lines 128 and 137 into the master cylinder 203. However, check valve 479 will block the further passage of pressurized fluid into the master cylinder 203 since spring 477 has shifted the piston 476 to close the passage and the pressurized fluid, while entering check valve 479, keeps the piston 476 pressed against the seat 475.

The housing of check valve 479 is threaded into the main valve body. The left hand side is drilled through to provide passage for the pressurized fluid and to provide a seat 475 and the right hand side of the housing is closed by the cap 478, on which are adapted lines 128 and 137, and the said cap 478 also holds the spring 477, which is on the other end engaging piston 475.

While the embodiment of this invention has been shown and described in detail, it is recognized that upon understanding this invention various other modifications and rearrangements will readily suggest themselves to those skilled in the art and may be resorted to without departing from the scope of the invention as defined in the claims.

I claim:

1. A hydraulically operated locking system comprising a pressurized fluid source, a master control valve and a slave valve each connected to said pressurized fluid source, a movable locking member, a piston cylinder assembly operatively associated with said slave valve and connected to the locking member for moving the same upon actuation of the slave valve and said slave valve being operatively associated with said master control valve for actuation thereby, said master control valve comprising a plurality of valves operatively interrelated and interconnected by passage means in series parallel relation such that, when selected ones thereof are operated in a predetermined sequence, they cause operation of the other ones of the interrelated valves so as to allow the pressurized fluid to flow through said passage means to the slave valve actuating the latter and means for actuating selected ones of said plurality of valves for operating the same in random sequence including said preselected sequence, said actuating means comprising a plurality of distributor valves arranged in at least one group and means for actuating the distributor valves individually and only one at a time in each group, said actuating means precluding operation of the other distributor valves when one of the valves in that group is being actuated.

2. A hydraulic locking system as defined in claim 1, including an alarm trigger associated with said master control valve and actuated thereby when a selected one of said plurality of valves is operated and which selected one is not included in said predetermined sequence.

3. A combination type locking comprising:

(a) a movable locking member;

(b) means operatively connected to the locking member for moving the same, said means being operable by a pressurized fluid medium; and (c) valve means for connection between a source of said fluid pressure medium and said locking member operating means for selectively actuating the latter to move the locking member, said valve means comprising a main valve body; a plurality of spring loaded slide valves mounted in said body, said valves being operatively interrelated and interconnected in series and parallel relationship by passage means with some of said valves being normally closed while others are normally open, said valves being arranged so that, when actuated in a predetermined sequence, a pressurized fluid from the source thereof flows through passages in the valve body to an outlet first passage; and an inlet second passage in said valve body adapted to be connected to said source of pressurized fluid; and manually operable means for randomly selecting actuation of selected ones of said plurality of valves in various sequences including said predetermined sequence and which selected ones of said valves cause actuation of other ones of said plurality of valves; said manually operable means comprising a plurality of distributor valves each individually operable for actuating selected ones of said plurality of slide valves in various sequences including said predetermined sequence, two of said distributor valves controlling flow of fluid from said second passage to two different ones of the spring loaded slide valves which in turn control flow of fluid to the remaining valves; and including passage means connecting said valves to a return terminal.

4. A combination type lock as defined in claim 3 including two spring loaded check valves arranged in series in said second passage, and wherein said two distributor valves are connected to said second passage between said check valves.

5. A combination type lock as defined in claim 3 wherein said outlet first passage is connected to the cylinder of a piston cylinder assembly.

6. A combination type lock comprising; a movable locking member; fluid operated means operatively connected to said locking member for moving the same; means controlling flow of a pressurized fluid to said fluid operated means comprising a plurality of valves operatively interrelated and interconnected by passage means in series-parallel relation, some of said valves being normally open and others normally closed, said valves being arranged in such a way that only when actuated in predetermined sequence the pressurized fluid will flow, through said passage means interconnecting said valves, to said fluid operated means; said operatively interrelated valves comprising two or more banks of valves arranged in parallel and at least two valves in each bank in series; a plurality of distributor valves arranged for actuating the interrelated valves in different sequences including said predetermined sequence; manually operable means for selectively actuating said distributor valves independent of one another, and an alarm trigger operatively associated with a selected one of said operatively interrelated valves for actuation thereby, said selected one of said valves not being included in said predetermined sequence.

7. A combination type lock comprising:

(a) a movable locking member;

(b) means operatively connected to said locking member for moving the same, said means being operable by a pressurized fluid medium;

(c) valve means controlling flow of pressurized fluid from a source of the same to said locking member operating means, said valve means comprising a plurality of valves operatively interrelated and interconnected by passage means in series-parallel relation, some of said valves being individually operable permitting actuation in various random sequences including a predetermined sequence and when actuated in said predetermined sequence cause actuation of other ones of the interrelated valves allowing said pressurized fluid to flow through said passage means to said lock operating means; and (d) means for actuating said individually operable valves, said actuating means comprising a plurality of distributor valves arranged in at least one group and manually operable means for actuating only one distributor valve at any one time in each group precluding at that time actuating the remaining distributor valves in that group.

8. A combination type lock comprising:

(a) a movable locking member;

(b) means operatively connected to the locking member for moving the same, said means being operable by a pressurized fluid medium; and (c) valve means for connection between a source of said fluid pressure medium and said locking member operating means for selectively actuating the latter to move the locking member, said valve means comprising a plurality of valves operatively interrelated and interconnected in series-parallel relation by passage means such that when actuated in a predetermined sequence the pressurized fluid passes therethrough to the locking member operating means to actuate the same, a plurality of operable distributor valves for actuating selective one of said plurality of valves and manually operable means for actuating said distributor valves, said manually operable means being arranged to actuate only one distributor valve at a time in a selected group of the same, and at that same time prevent actuation of the remaining ones of the distributor valves in that group, said distributor valves permitting actuating the plurality of operative interrelated valves in various sequences including said predetermined sequence.

9. A combination type lock as defined in claim 8 wherein said plurality of operatively interrelated valves comprises a first group of a plurality of spring loaded slide valves mounted in a common body and a second group of a plurality of spring loaded slide valves, each of said valves in said second group being individually operable.

10. A vault door lock comprising a motor driven pump for supplying fluid under pressure and having an inlet line connected to a reservoir and an outlet line connected to a valve system, said valve system comprising a master control valve assembly consisting of a plurality of operatively interrelated valves, a plurality of individually operable distributor valves for actuating said interrelated valves and a slave valve actuated by said master control valve, said slave valve being connected to the pump outlet line, to the cylinders of a piston cylinder assembly operatively connected to locking pins movable mounted on the vault door and said reservoir, and an actuating mechanism for said distributor valves comprising at least one dial rotatably mounted on the vault door and having a shaft reciprocally mounted therein, said shaft being aligned with different ones of the distributor valves when said dial is rotated to different designated positions.

11. A control valve assembly for use in a fluid pressure operated door locking system, said control valve assembly comprising an assembly of nineteen valves mounted in a common body and arranged in such a way that said valves permit the passage of pressurized fluid through the body when actuated in a predetermined sequence, a first passage in said body adapted to be connected to a pressurized fluid source and into which passage the pressurized fluid enters through two check valves, a second passage in said body connected to six of said nineteen valves, said six valves being arranged to open when said valves are actuated in said predetermined sequence allowing pressurized fluid to flow into a cylinder in said body and which cylinder is at the end of said second passage, a piston reciprocally mounted in said cylinder and arranged so that, when pressurized fluid enters said cylinder, said piston actuates a door locking mechanism to unlock the door; a third passage in said body having one end thereof connected to a return reservoir and the other end connected to twelve of said valves different from the previously mentioned six valves, said twelve valves being arranged to be open when the valves have been actuated in said predetermined sequence, pressurized fluid in a master cylinder in the valve body will flow through said third passage into the return reservoir; a fourth passage in said body having one end thereof connected to the remaining one of said valves and the other end connected to a plurality of distributor valves, said one valve being arranged so that when the fluid flows therethrough pressurized fluid will flow through the said fourth passage into said distributor valves, a return terminal in which are installed eighteen check valves threaded into said body and interconnected by a fifth passage in said body extending from one check valve to another, said fifth passage being connected to two of said nineteen valves arranged so that, when pressurized fluid enters one passage, a check valve blocks passage of the fluid into the other passage and when the said two valves are in the open position, the fluid will flow through the check valves into said passage and through the said two valves into the return reservoir, a master cylinder in said body having one end thereof adapted for connection to the pressure fluid source and a piston reciprocally mounted therein for movement by the fluid against a compression spring, two relief valves communicating with said master cylinder for relieving excess pressure therein and a check valve stopping pressurized fluid from escaping out of the master cylinder to the fluid pressure source.

12. A control valve assembly as defined in claim 11 wherein said distributor valves consist of eight valves in each of three distributor valve assemblies, said distributor valves in each assembly being arranged in a circle and actuated by pressing a shaft reciprocally mounted in a dial mounted for rotation about an axis passing through the center of said circle.

* * * * *